US009613492B2

(12) United States Patent
Englman et al.

(10) Patent No.: US 9,613,492 B2
(45) Date of Patent: Apr. 4, 2017

(54) GAMING SYSTEM HAVING SYSTEM WIDE TOURNAMENT FEATURES

(71) Applicant: WMS Gaming Inc., Waukegan, IL (US)

(72) Inventors: Allon G. Englman, Chicago, IL (US); Michael W. Mastropietro, Chicago, IL (US); Dylan B. Selegue, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 8 days.

(21) Appl. No.: 14/145,729

(22) Filed: Dec. 31, 2013

(65) Prior Publication Data

US 2014/0228098 A1 Aug. 14, 2014

Related U.S. Application Data

(63) Continuation of application No. 13/128,582, filed on May 10, 2011, now Pat. No. 8,622,817.

(51) Int. Cl.
*G07F 17/32* (2006.01)
*G07F 17/34* (2006.01)

(52) U.S. Cl.
CPC ..... *G07F 17/3244* (2013.01); *G07F 17/3272* (2013.01); *G07F 17/3276* (2013.01); *G07F 17/34* (2013.01)

(58) Field of Classification Search
CPC ..... G07F 17/3272; G07F 17/3244; G07F 17/3276
See application file for complete search history.

(56) References Cited

U.S. PATENT DOCUMENTS

| | | | |
|---|---|---|---|
| 5,083,271 | A | 1/1992 | Tacher et al. |
| 5,664,998 | A | 9/1997 | Seelig et al. |
| 5,711,715 | A | 1/1998 | Ringo et al. |
| 5,755,621 | A | 5/1998 | Marks et al. |
| 5,779,242 | A | 7/1998 | Kaufmann |
| 5,779,549 | A | 7/1998 | Walker et al. |

(Continued)

FOREIGN PATENT DOCUMENTS

| | | | |
|---|---|---|---|
| JP | 07-059944 | 3/1995 | ..... A63F 13/00 |
| JP | 2004-261236 | 9/2004 | ..... A63F 13/10 |

(Continued)

OTHER PUBLICATIONS

International Search Report PCT/US2009/063376 dated Feb. 26, 2010, 3 pages.

*Primary Examiner* — Corbett B Coburn
(74) *Attorney, Agent, or Firm* — Nixon Peabody LLP

(57) ABSTRACT

Disclosed is a multi-mode gaming terminal that utilizes at least one controller to detect a selection between a cash mode of operation and a tournament mode of operation. If the cash mode is selected, the terminal executes a wagering game with a first payback return. If the tournament mode is selected, the terminal executes the wagering game with a second payback return and a tournament return. In tournament mode, for each tournament eligible play of the wagering game resulting in a winning outcome, a predetermined number of tournament points are added to a tournament entry and, upon the occurrence of a triggering event, the tournament entry is entered into a tournament.

12 Claims, 21 Drawing Sheets

(56) References Cited

U.S. PATENT DOCUMENTS

| | | | | |
|---|---|---|---|---|
| 6,039,648 | A * | 3/2000 | Guinn et al. | 463/16 |
| 6,093,100 | A | 7/2000 | Singer et al. | |
| 6,224,486 | B1 | 5/2001 | Walker et al. | |
| 6,287,202 | B1 | 9/2001 | Pascal et al. | |
| 6,293,865 | B1 | 9/2001 | Kelly et al. | |
| 6,309,299 | B1 | 10/2001 | Weiss | |
| 6,315,668 | B1 | 11/2001 | Metke et al. | |
| 6,425,828 | B2 | 7/2002 | Walker et al. | |
| 6,817,948 | B2 | 11/2004 | Pascal et al. | |
| 6,908,390 | B2 | 6/2005 | Nguyen et al. | |
| 2002/0039923 | A1 | 4/2002 | Cannon et al. | 463/42 |
| 2005/0020352 | A1 | 1/2005 | Chilton et al. | 463/20 |
| 2005/0043088 | A1 | 2/2005 | Nguyen et al. | 463/29 |
| 2005/0043089 | A1 | 2/2005 | Nguyen et al. | 463/29 |
| 2005/0043094 | A1 | 2/2005 | Nguyen et al. | 463/42 |
| 2005/0071024 | A1* | 3/2005 | Henshaw | 700/91 |
| 2005/0102047 | A1 | 5/2005 | Ottofy | 700/91 |
| 2005/0148380 | A1 | 7/2005 | Cannon et al. | 463/16 |
| 2005/0181856 | A1 | 8/2005 | Cannon et al. | |
| 2005/0221882 | A1 | 10/2005 | Nguyen et al. | |
| 2006/0281509 | A1 | 12/2006 | Arias-Vargas et al. | |
| 2007/0026935 | A1* | 2/2007 | Wolf et al. | 463/25 |
| 2007/0293293 | A1 | 12/2007 | Baerlocher et al. | |
| 2007/0298857 | A1 | 12/2007 | Schlottmann et al. | |
| 2008/0139305 | A1 | 6/2008 | Vallejo et al. | |
| 2008/0254883 | A1 | 10/2008 | Patel et al. | |
| 2010/0120522 | A1* | 5/2010 | Englman et al. | 463/26 |
| 2011/0014964 | A1* | 1/2011 | Crowder et al. | 463/13 |
| 2012/0129593 | A1 | 5/2012 | Englman | |
| 2014/0228098 | A1* | 8/2014 | Englman | G07F 17/3244 463/25 |
| 2014/0248953 | A1* | 9/2014 | Kelly et al. | 463/31 |

FOREIGN PATENT DOCUMENTS

| | | | |
|---|---|---|---|
| JP | 2008-049200 | 3/2008 | A63F 13/10 |
| WO | WO 2006/015442 | 2/2006 | A63F 13/12 |

* cited by examiner

1202

Prize Proportion Table

| Finishing Position | Total Number of Entries | | | | | |
|---|---|---|---|---|---|---|
| | 9-27 | 28-36 | 37-45 | 46-54 | 55-63 | 64-72 |
| 1st | 50.00% | 45.00% | 40.00% | 38.00% | 35.00% | 33.50% |
| 2nd | 30.00% | 25.00% | 23.00% | 22.00% | 21.00% | 20.50% |
| 3rd | 20.00% | 18.00% | 16.00% | 15.00% | 15.00% | 14.50% |
| 4th | | 12.00% | 12.00% | 11.00% | 11.00% | 11.00% |
| 5th | | | 9.00% | 8.00% | 8.00% | 8.00% |
| 6th | | | | 6.00% | 6.00% | 6.00% |
| 7th | | | | | 4.00% | 4.00% |
| 8th | | | | | | 3.00% |

FIG. 12

Tournament Multiplier Tracking Table

1302

| | Bet Per Line | Tournament Multiplier |
|---|---|---|
| Spin 1 | 1 | 1 |
| Spin 2 | 2 | 1.5 |
| Spin 3 | 1 | 1.33 |
| Spin 4 | 5 | 2.25 |
| Spin 5 | 5 | 2.80 |
| Spin 6 | 5 | 3.17 |
| Spin 7 | 1 | 2.86 |
| Spin 8 | 1 | 2.63 |
| Spin 9 | 1 | 2.44 |
| Spin 10 | 101 | 3.20 |

1402

Example Tournament Accounting

| | | |
|---|---|---|
| Tournament Number | 16584 | 1404 |
| Number of Entries | 72 | 1406 |
| Number of Games in Tournament | 100 | 1408 |
| Base Denom | 0.01 | 1410 |
| Base Bet | $ 0.30 | 1412 |
| Tournament EV | 9% | 1414 |
| Tournament Fee | 1% | 1416 |
| Prize Pod | 194.40% | 1418 |

| 1420 Finishing Position | 1422 Payout % | 1424 Tournament Multiplier Total Payout | 1424 Total Payout |
|---|---|---|---|
| 1st | 33.5% | 4.2 | $ 273.52 |
| 2nd | 20.5% | 1.1 | $ 43.84 |
| 3rd | 14.5% | 6.8 | $ 191.68 |
| 4th | 11.0% | 1.3 | $ 27.80 |
| 5th | 8.0% | 1.0 | $ 15.55 |
| 6th | 6.0% | 2.9 | $ 33.83 |
| 7th | 4.0% | 8.0 | $ 62.21 |
| 8th | 3.0% | 4.0 | $ 23.33 |

TOTAL OUTLAY $ 671.75 — 1428

AVERAGE PLAYER MULTIPLIER 28 — 1434

TOTAL INCOME $ 604.80 — 1430

NET REVENUE $ (66.95) — 1432

FIG. 14

GAMING SYSTEM HAVING SYSTEM WIDE TOURNAMENT FEATURES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus, and methods for playing wagering games, and more particularly, to a gaming systems having system wide tournament features.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Therefore, there is a continuing need for gaming machine manufacturers to continuously develop new games and improved gaming enhancements that will attract frequent play through enhanced entertainment value to the player.

One way to enhance the entertainment value of game is to provide a gaming system having system wide tournament features so as to involve a player in a tournament where play may occur on different games at different time, and where players may still be able to compete against each other. The present invention is directed to a gaming system having system wide tournament features including tournament play that may occur on different games at different times and gaming terminals operable in both a cash mode and a tournament mode.

SUMMARY OF THE INVENTION

According to one aspect of the present invention, a multi-mode gaming terminal includes, a wager input device, a primary display for displaying a primary wagering game. The gaming terminal also includes at least one controller operative to: (i) detect a selection between a cash mode of operation and a tournament mode of operation; (ii) if the cash mode is selected, execute the primary wagering game configured with a first payback return; (iii) if the tournament mode is selected, execute the primary wagering game in a tournament mode configured with a second payback return and a tournament return, wherein on each tournament eligible play of the primary wagering game resulting in a winning outcome, a predetermined number of tournament points are awarded and added to a tournament entry; and (iv) upon the occurrence of a triggering event, entering the tournament entry into at least one tournament.

According to another aspect of the invention, the invention comprises a gaming system having system wide tournament features, comprising a wager input device, a first gaming terminal comprising a first display for displaying a first wagering game, a second gaming terminal comprising at least a second display for displaying a second wagering game, a tournament server in communication with the first and second gaming devices. The gaming system further comprises at least one controller operative to (i) detect that each of the first and second gaming terminals is operating in a tournament mode; (ii) activating a tournament for a predetermined time period; (iii) receive a first tournament entry comprising a first tournament score collected during a predetermined number of plays of the first wagering game; (iv) receive a second tournament entry comprising a second tournament score collected during the predetermined number of plays of the second wagering game; (v) analyze the first tournament score, the second tournament score, and any other tournament scores received to determine a finishing order and prize pool; and (vi) award to at least one player a tournament award, the tournament award dependent upon the at least one player's position in the finishing order.

According to yet another aspect of the invention, a method of conducting a wagering game on a gaming system comprises, receiving a plurality of wagers from a first player at a first gaming terminal displaying a first wagering game; executing X plays of the first wagering game on the first gaming terminal, wherein on each winning outcome of the first wagering game, a predetermined number of tournament points are added to a cumulative tournament score associated with the first player. The method further includes, receiving a plurality of wagers from a second player at a second gaming terminal displaying a second wagering game; executing X plays of the second wagering game on the second gaming terminal, wherein on each winning outcome of the second wagering game, a predetermined number of tournament points are added to a cumulative tournament score associated with the second player; logging the first player's tournament score, the second player's tournament score, and any other players' tournament scores to determine a number of participants in the tournament and a finishing order of the participants; and awarding to at least one participant a tournament award based at least in part on the at least one participant's position in the finishing order.

According to still another aspect of the invention, a method of conducting a wagering game on a gaming system comprises identifying participants in the tournament by receiving a player identifier from each such participant, receiving from each participant in the tournament at least one wager. The method further comprises receiving from each participant in the tournament a tournament score comprising a total number of tournament points collected during X plays of one of a plurality of wagering games, wherein each play of the wagering game comprises displaying a randomly selected outcome from a plurality of available outcomes, wherein upon the occurrence of winning outcome, a predetermined number of tournament points associated with such winning outcome is awarded.

According to still yet another aspect of the invention, a method of conducting a wagering game on a gaming system comprises determining a number of participants in the tournament; determining a number of paid finishing positions for which an award will be paid, the number of paid finishing positions dependent upon the number of participants; receiving from each participant a tournament score, the tournament score comprising the sum of all tournament points earned during a predetermined number of plays of a wagering game, wherein each winning outcome of the wagering game includes an award of at least one credit and at least one tournament point. The method also includes ranking the received tournament scores from largest to smallest to determine a finishing order including the paid finishing positions; identifying the participants in the paid finishing positions; and awarding each of the participants in the paid finishing positions a tournament award.

According to still yet another aspect of the invention, a method of conducting a wagering game on a gaming system comprises executing and displaying a predetermined number of plays of a wagering game having a range of available credit awards, each play comprising a randomly selected outcome; for each play of the wagering game yielding a winning outcome associated with a winning credit award, determining a tournament point award, wherein the tournament point award is mathematically associated with a first subrange of credits within the range, the subrange including the winning credit award. The method also includes summing up the tournament points earned in the predetermined number of plays of the wagering game to arrive at a tournament entry score; and awarding a tournament award to at least one participant in the wagering game tournament based at least in part on the participant's tournament score relative to the tournament scores of other players participating in the wagering game tournament.

According to yet another aspect of the invention, one or more computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 12 is an image of a prize proportion table depicting an example distribution of tournament prizes based in part on number of entries in the tournament.

FIG. 14 is an image of an example tournament accounting chart.

Figure 1A:
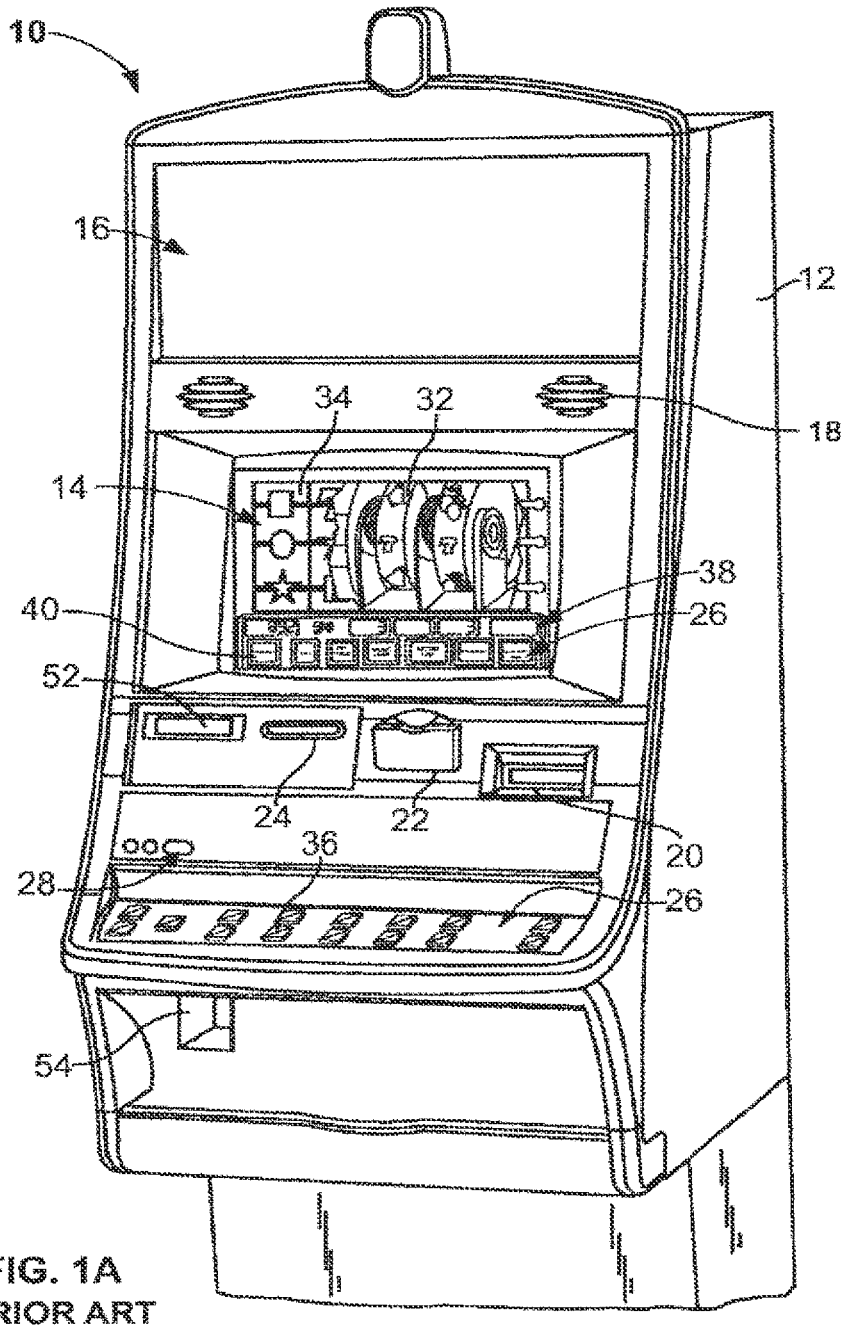
FIG. 1A PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
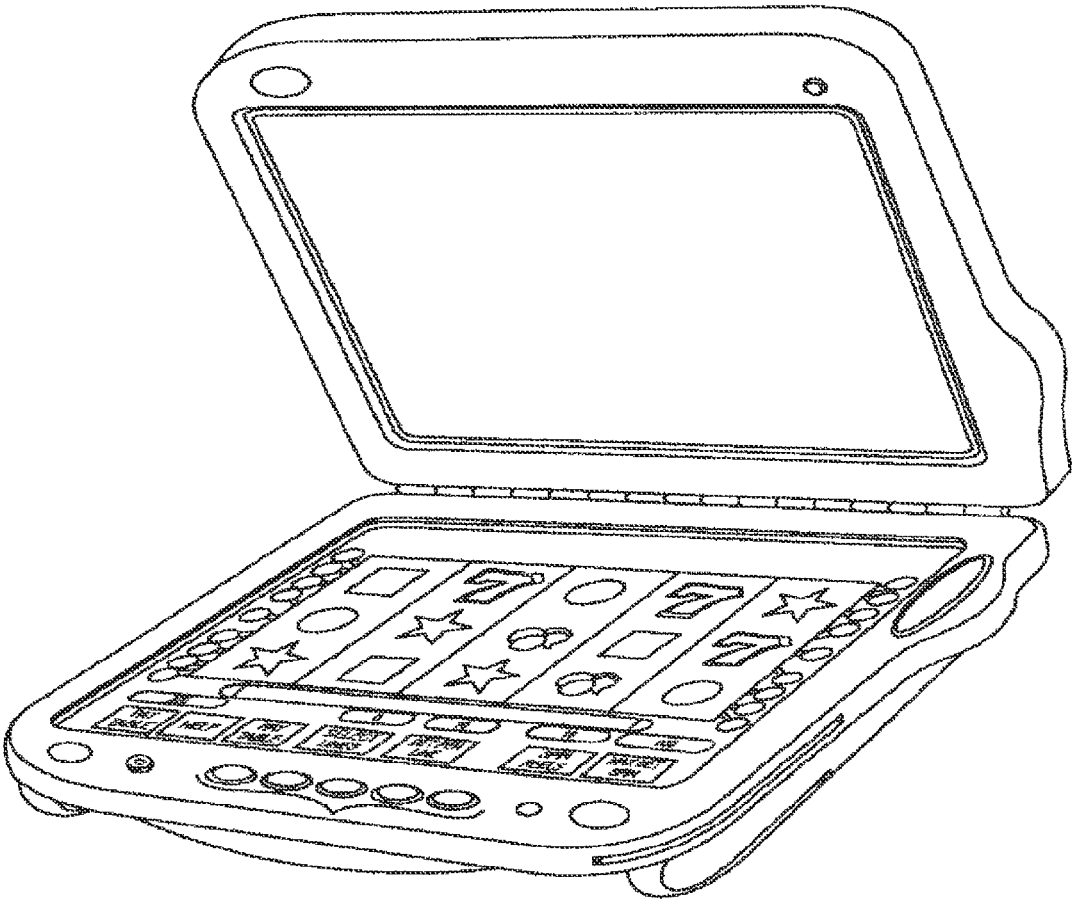
FIG. 1B PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
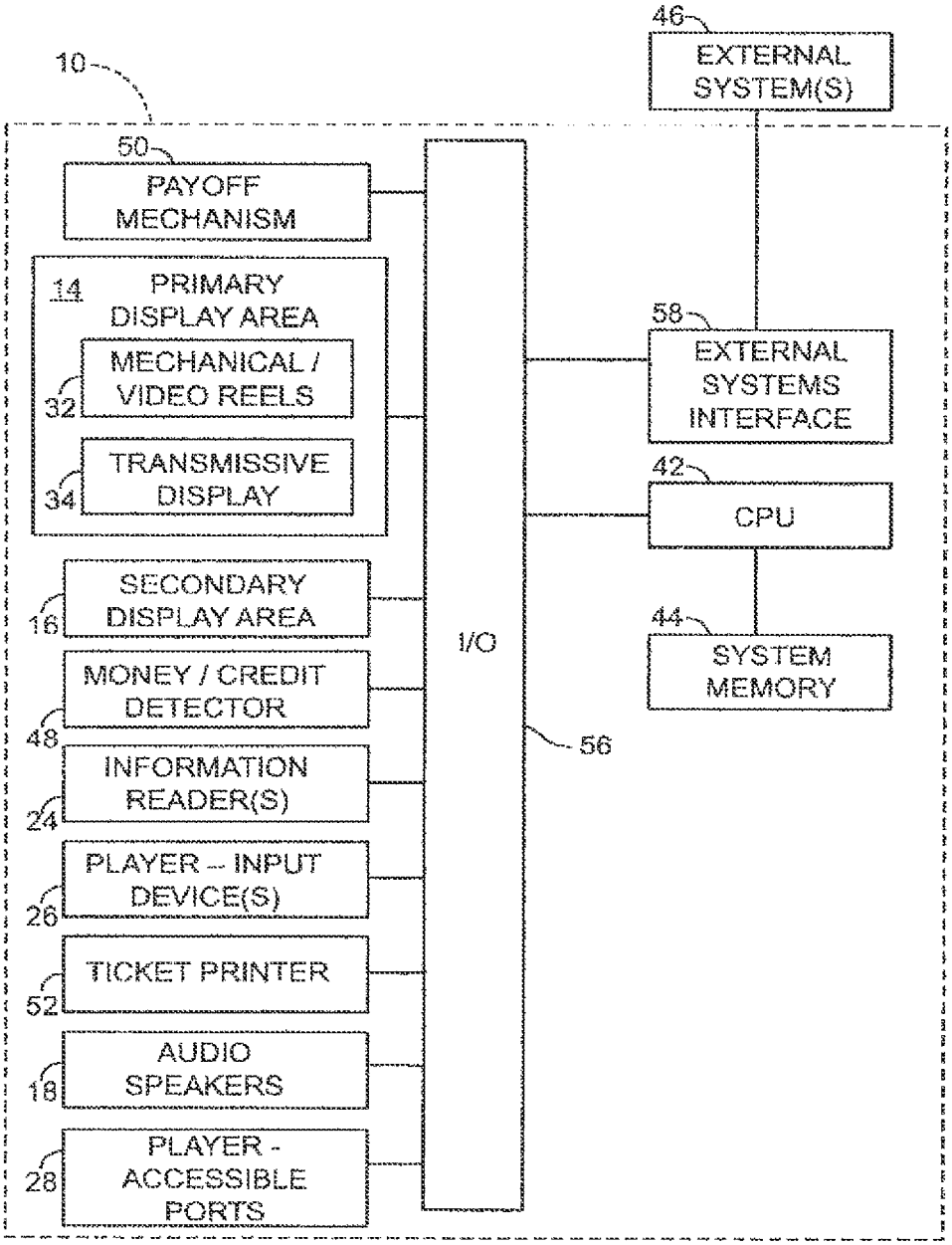
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
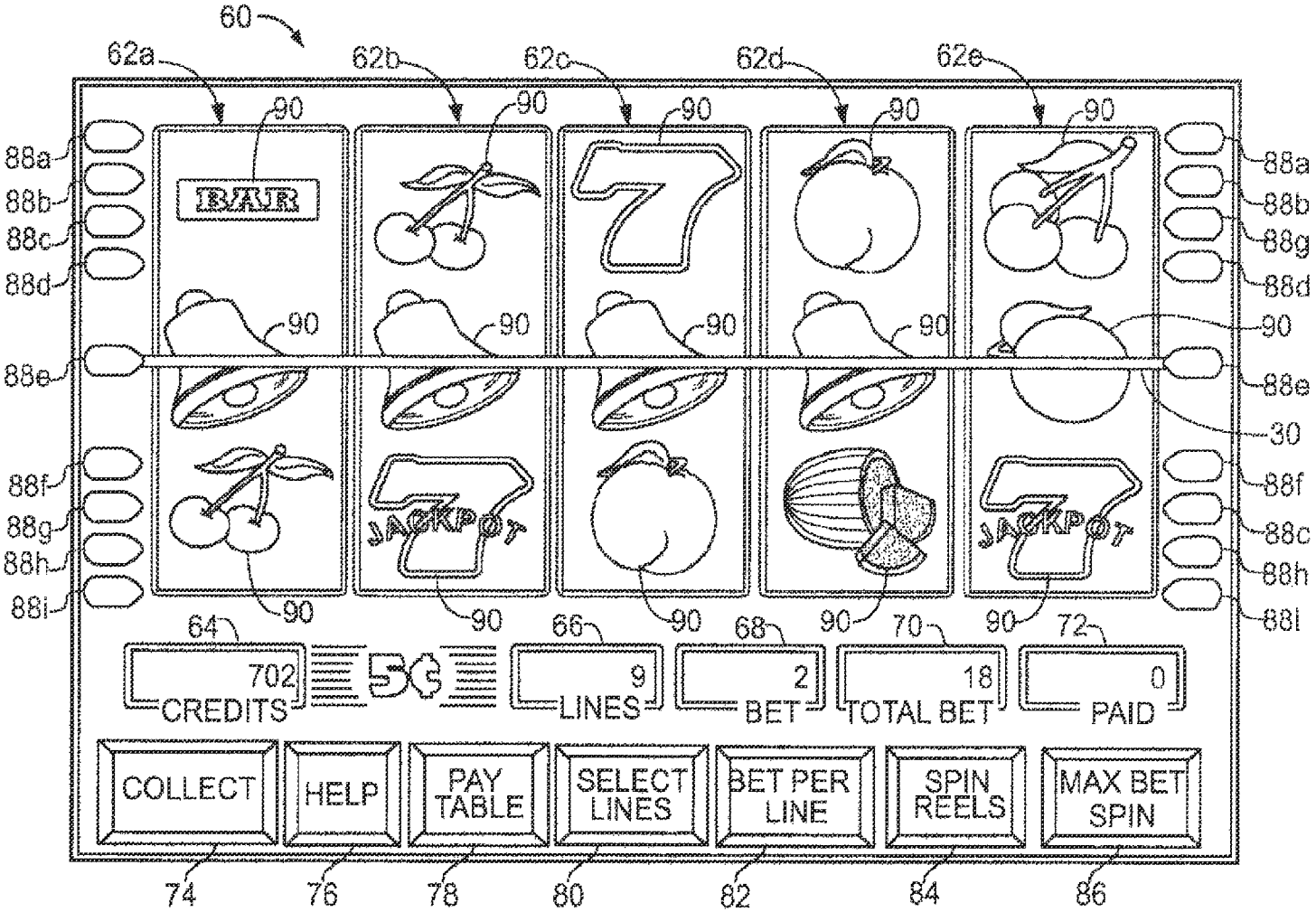
FIG. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
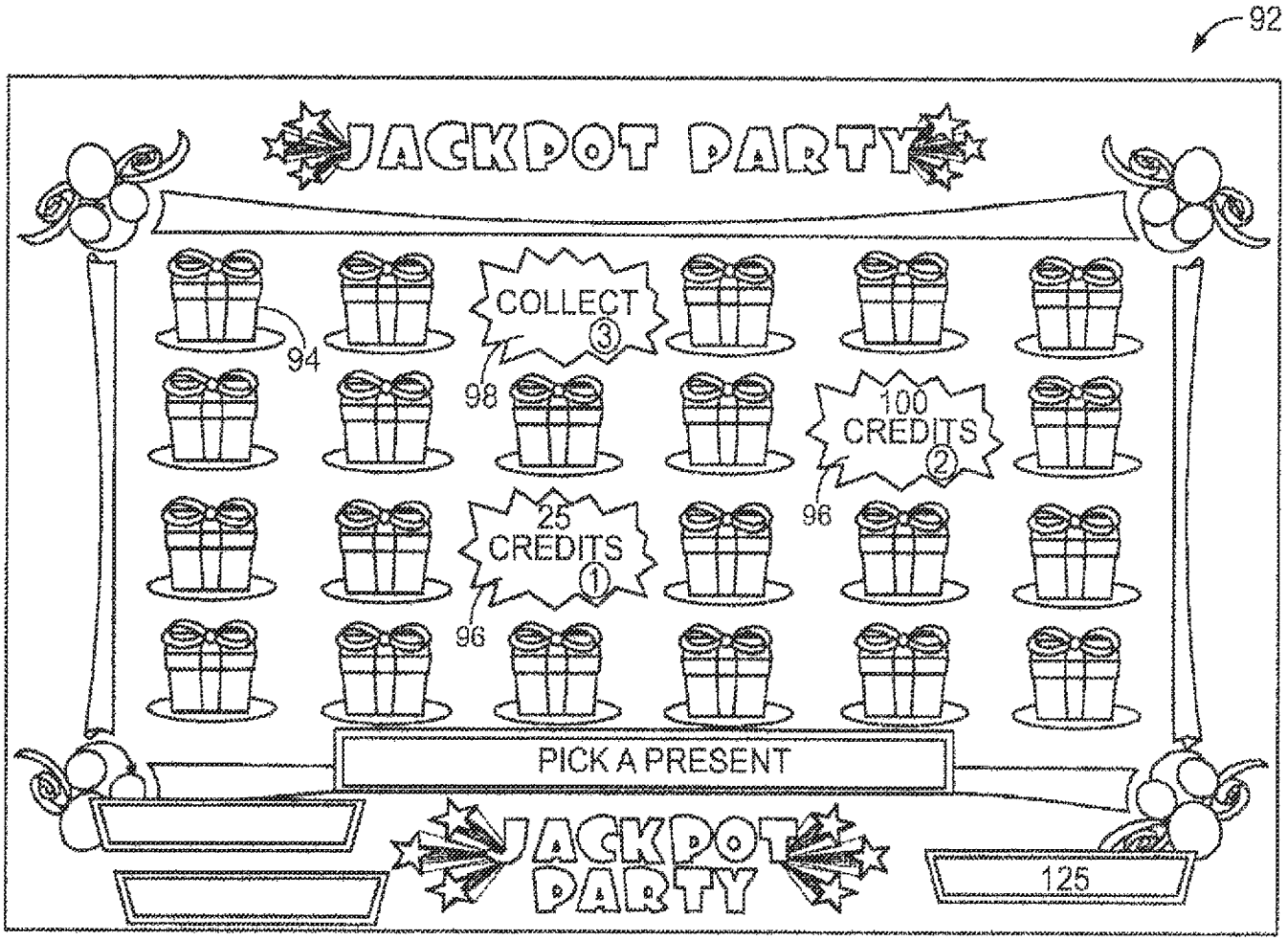
FIG.4 PRIOR ART
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
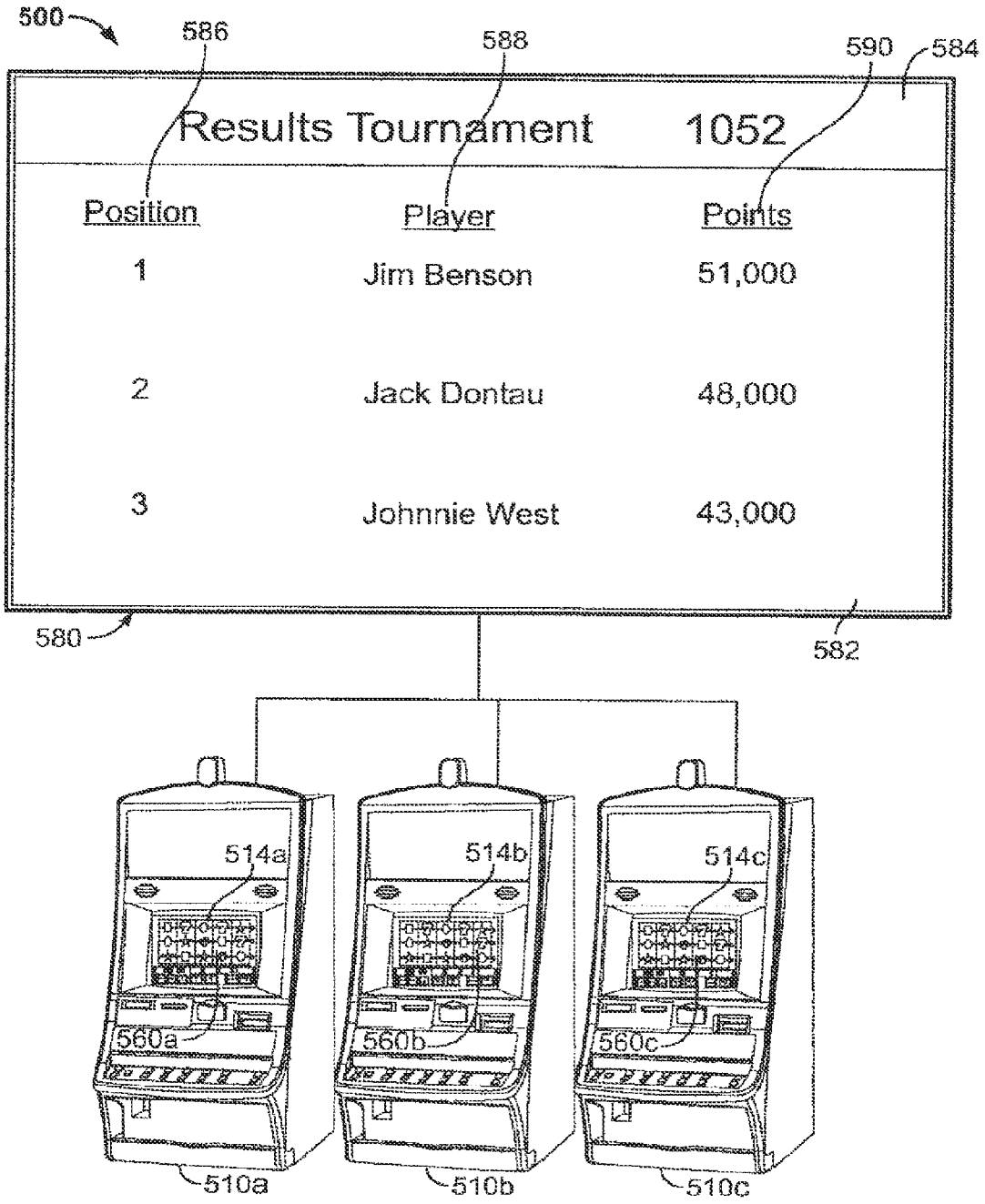
FIG. 5 is a depiction of a gaming system including a plurality of gaming terminals and a community display.

Turning to FIG. 5, a gaming system 500 including system wide tournament play features is displayed. The system 500 includes a plurality of gaming devices 510*a,b,c*, each of which include at least a primary display 514*a,b,c* for displaying game events thereon. Each of the primary displays 514*a,b,c* may be any form of display such as those described herein with reference to the free standing and handheld gaming devices of FIGS. 1*a* and 1*b*. The primary displays 514*a,b,c* may include a display of a primary wagering game 560*a,b,c*, which in this embodiment are slot games as shown in FIG. 5. The primary wagering games 560*a,b,c* may include a plurality of reels, which may be either electromechanical reels or simulations thereof on the primary display 514*a,b,c*. The reels may include a plurality of symbols thereon which vary as the reels are spun and stopped. The symbols may include any variety of graphical symbols, elements, or representations, including symbols which are associated with one or more themes of the gaming machine 510*a,b,c* or system 500. The symbols may also include a blank symbol, or empty space. The primary wagering games 560*a,b,c* shown on the various primary displays 514*a,b,c* of the system 500 may be the same, similar, or different in nature, game play, theme, denomination, formation, eligibility, etc.

As described herein, in some embodiments, symbols landing on the active pay lines (the pay lines for which a wager has been received) are evaluated for winning combinations. A combination of symbols that lands on an active pay line is a winning outcome for which an award may be paid in accordance with a payable of the gaming device 510*a,b,c* or system 500. The symbols on the reels form an array or matrix of symbols, having a number of rows and columns, which in the embodiment shown is three rows and five columns. In alternate embodiments, the array may have greater or fewer symbols, and may take on a variety of different forms having greater or fewer rows and/or columns. The array may even comprise other non-rectangular forms or arrangements of symbols. In alternative embodiments, other criteria may be used for winning combinations, such as symbol arrangement or configuration without regard to paylines.

The system 500 further includes a community display 580, which in this embodiment is an LCD, plasma, or other flat-screen display mounted and positioned above the plurality of gaming devices 510*a,b,c*. The community display 580 displays a tournament event 582 which includes prize and award information related to the tournament event 582 and may optionally include progress and results of one or more players participating in the tournament event 582. In the embodiment shown, the tournament event 582 comprises a plurality of players participating in an hour-long slot tournament with the three highest finishing players receiving various awards. In alternative embodiments, the tournament event 582 may be based on other time periods, such as weekly, monthly, and daily tournaments. In some embodiments, players can choose to play the gaming terminals in a cash payout mode (in which they do not participate in the tournament event 582) or in a tournament mode (in which they do compete in one or more tournament events 582). Other configurations are possible.

The display 580, in this example, communicates information concerning results of one or more tournaments. In an embodiment, the community display 580 displays a tournament number 584, final positions 586, player names 588, and tournament award 590. In some embodiments, the tournament number 584 uniquely identifies a tournament so that a player is informed as to which tournament results are being displayed on the community display 580. The final position 586 identifies the finishing position of a player, while the player name 588 field identifies the associated player by name (or other identifier). The display 580 may display a portion of the finishing order 586, or the entire finishing order of all participating players. The tournament award 590 field displays the number of tournament points or other awards accumulated or earned by a player in the respective tournament. The display 580 may be configured to display information about any facet of a tournament that is ongoing, has occurred or is going to occur. For example, the prize pool and the number of participants in an ongoing tournament may be displayed. Winning and results histories may also be displayed on the community display 580.

The community display 580 may be placed in any appropriate place within a casino or operator's facility, for example, a gaming room in a casino, the entry area of a casino, elevators of a casino, or any other public place inside or outside of a casino. Publicly displaying tournament information creates a community environment for tournament participants so as to incentive players to play in such available tournaments. Players may discuss their results or the results of others. Seeing and discussing the results of others may create an environment of friendly competition. This competition may spur some players to compete in more tournaments and new players to try tournament play. This environment of community and competition may also create player loyalty. It should be noted that the information provided on the community display may be limited or delayed as desired by a casino or tournament provider. For example, the high scores for a particular tournament may not be posted until after a tournament has been completed (as opposed to real-time tracking) to prevent players from "tournament shopping" and completing their final spins only for tournaments with relatively low top scores.

Figure 6:
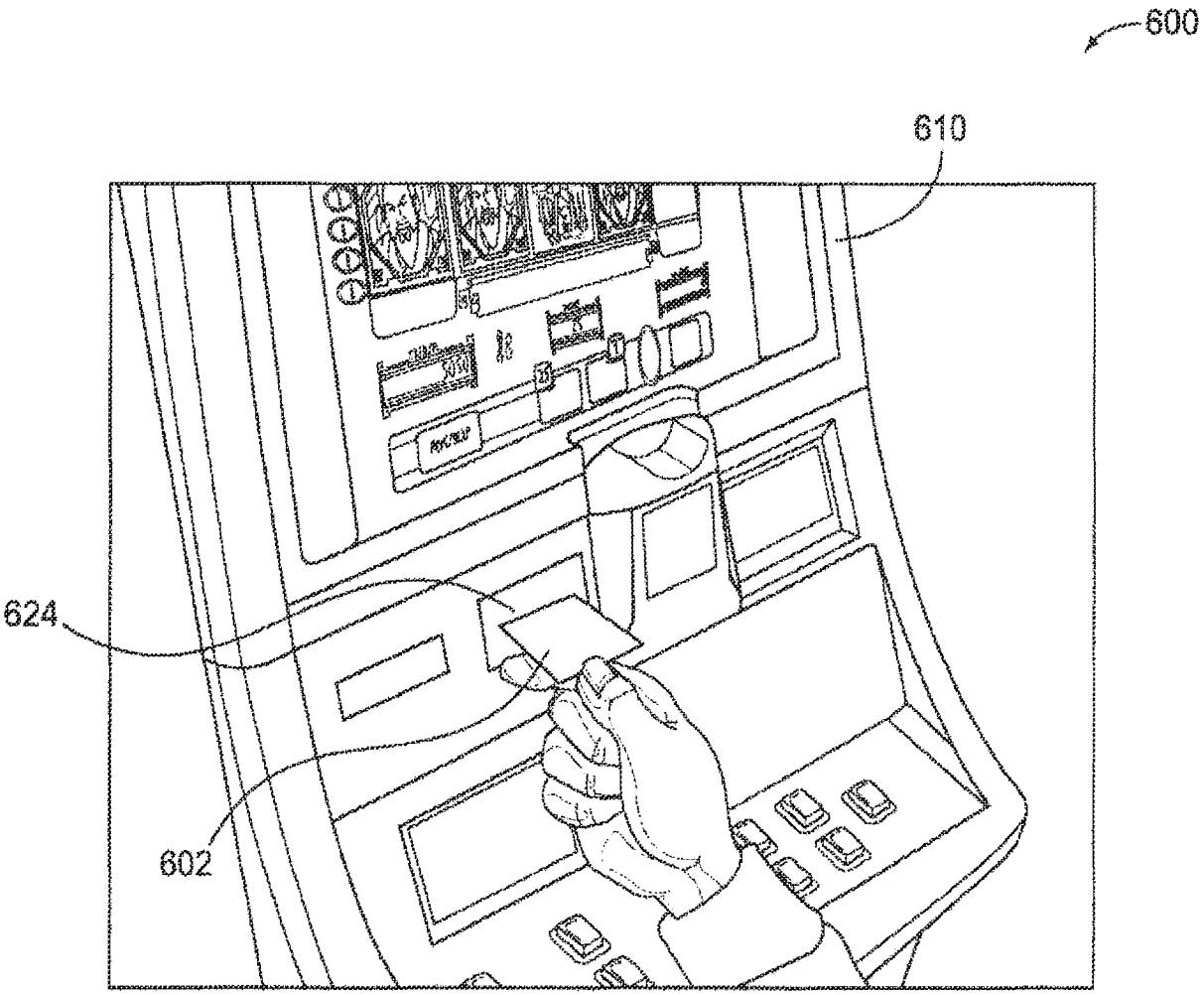
FIG. 6 is an image of a player inserting a player's card into a gaming terminal.

Turning to FIG. 6, depicted is a player inserting his player's card 602 into a card or information reader 624 of a gaming machine 610 of a gaming system 600. In an embodiment, the gaming system 600 having system wide tournament features administers tournament participation and results by identifying various players desirous of participating in one or more tournaments. When a player inserts his player's card 602, the gaming system 600 identifies the player (for example by recalling a player account associated with a number stored on the card) and then tracks the player's game play, storing information related to the player's results in primary wagering games and progress in the tournament(s) in which the player has chosen to participate. In one embodiment, a player must have a player's card (or other player identifier as described herein) in order to participate in one or more tournaments and tournament features offered by the system 600.

In this embodiment, the player's card 602 may contain a player identifier, and may also contain or be associated with player preferences and tournament status information. The player identifier may be a player name, or some type of player number, symbol, or alphanumeric string that uniquely identifies the player. Once a player is identified via his identifier, associated player preferences and tournament status information may be recalled or downloaded by the system to the local gaming terminal 610 on which the player is playing. Player preferences may include machine settings a player may prefer when playing a game, such as, for example, whether buttons should be arranged for a left-handed player or a right-handed player. Many other player preferences may be stored and recalled as well, such as color schemes, themes, graphics, animations, sounds, wager information, pay line configurations, etc. Tournament status information may include an identifier that identifies tournaments a player may be registered for or currently playing. In an embodiment, tournament status information may also include the number of spins a player has already expended in a tournament, accumulated credits, and other information that may be needed to determine a player's tournament standing. A variety of other player preferences and/or tournament status information may be associated with the player identifier and recalled or downloaded when the player card (or other identifier) is inserted.

Figure 7:
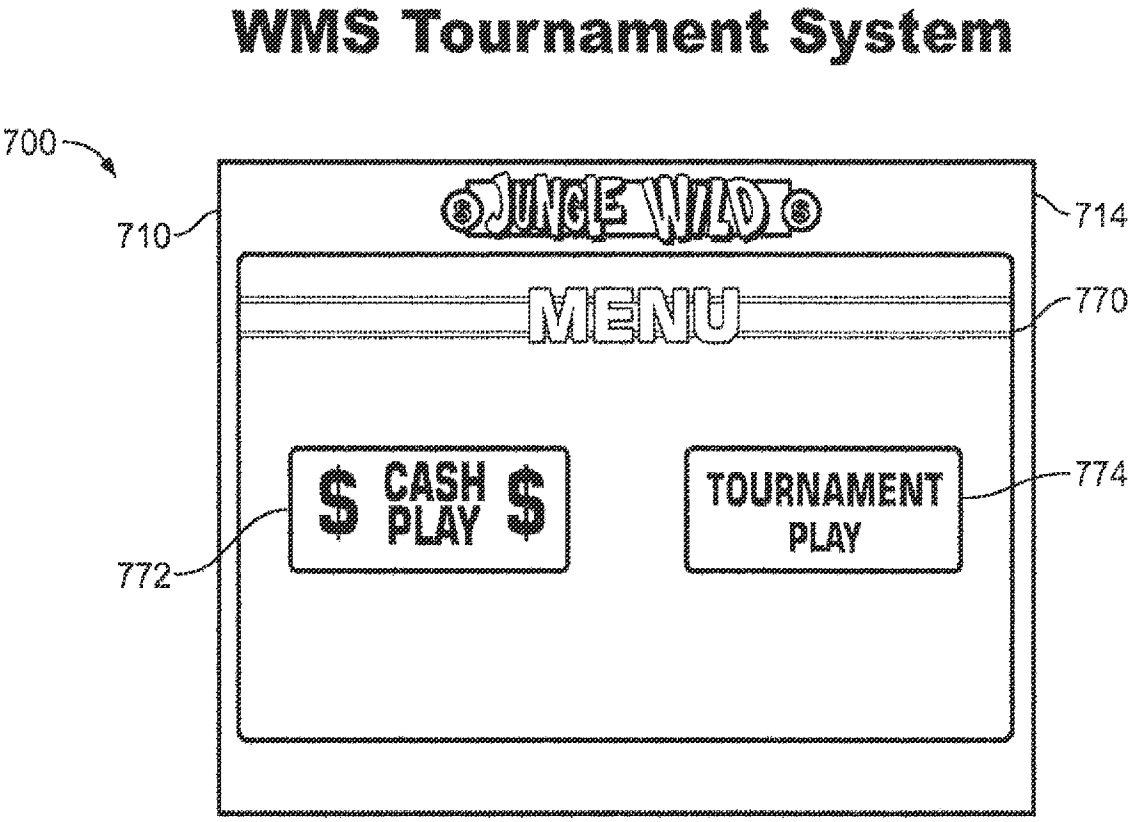
FIG. 7 is an image of a primary display of a gaming device in which a player is prompted to select operation of the gaming device in either a cash play mode or a tournament play mode.

Turning to FIG. 7, depicted is a primary display 714 of a gaming terminal 710 of a gaming system 700 having system wide tournament features, such as the system depicted in FIG. 5. The primary display 714 is configured to display a primary wagering game, as in FIG. 5. As seen in FIG. 7, after a player inserts his player card (or other identifier), or otherwise logs in to a gaming terminal 700, the primary display 714 changes to display a pop up window 770 having a plurality of game configuration selections 772, 774. A first game configuration selection 772 is entitled "Cash Play" and corresponds with a cash play mode, as described further herein. A second game configuration selection 774 is entitled "Tournament Play" and corresponds with a tournament play mode, as described further herein. Thus, one or more gaming devices or terminals 710 in the gaming system 700 is configured to operate in either a cash play mode or a tournament play mode. In some embodiments, the choice of which mode is left to the player, and made via player selection as described. In other embodiments, the selection of which mode to operate in may be random, or dependent upon operator selection, criteria, or rule sets.

When the Cash Play button 772 is selected, the gaming terminal 710 operates in a cash play mode, which is a normal or non-tournament mode. In the cash play mode, the player inputs wagers into a primary wagering game (such as a slot game). The results of the primary wagering game are randomly selected and displayed via the primary display 714. For example, in a slot game, the symbol bearing reels are spun and stopped to reveal outcomes which are evaluated for winning combinations of symbols (or winning outcomes). If one or more winning combinations of symbols occur in the randomly selected outcome, the player is awarded credits (or other prizes) in accordance with a pay table of the gaming terminal 710. When playing in cash play mode, the wagering game is configured to operate with a predetermined return or expected value. For example, in one embodiment, the wagering game return is 90%. Thus, for every $1.00 of wagers input into the wagering game, the game returns, on average, $0.90, or 90%. Thus, in this embodiment shown in FIG. 7, the base game return is configured to be 90%.

In tournament mode, the player again inputs wagers into a primary wagering game (such as a slot game). The appearance of the wagering game is the same as in cash mode, that is, the reels are spun and stopped to reveal randomly selected outcomes of symbols which are evaluated for winning combinations. However, mathematically the tournament mode differs from the cash mode. In tournament mode, the wagering game includes a base game return percentage, a tournament return percentage, and optionally, a tournament fee percentage. Thus, for each wager input into the wagering game in tournament mode, a portion of the wager funds the base game return, a portion of the wager funds the tournament return, and a portion of the wager funds a tournament fee. In one embodiment, the base game return is 80%, the tournament return is 9%, and the tournament fee is 1%. In tournament mode, the net return is the sum of the base game return and the tournament return. In this embodiment, the net return is 89% (80%+9%=89%). In another embodiment, the tournament return is 10%, and the net return is 90% (80%+10%=90%). Thus, as can be seen, in this latter embodiment, the net return in tournament mode would be the same as the base game return in base mode. The tournament fee may is optional and may be a fee charged by the operator or manufacturer to offset the administrative, hardware, and software costs associated with equipment and personnel necessary to operate the tournaments available.

Thus, it should be understood that in an embodiment, regardless of the player's choice of cash play or tournament play mode, their net expected return is the same. The difference between the two modes is that in the tournament mode, the base game return is reduced to allow a portion of each wager (the tournament return) to fund a prize pool for the various available tournaments. A significant different between the modes is that in tournament mode, each spin or play of the underlying wagering game has the potential for contributing to a tournament score which comprises a tournament entry for the player in an activated tournament.

Figure 8:
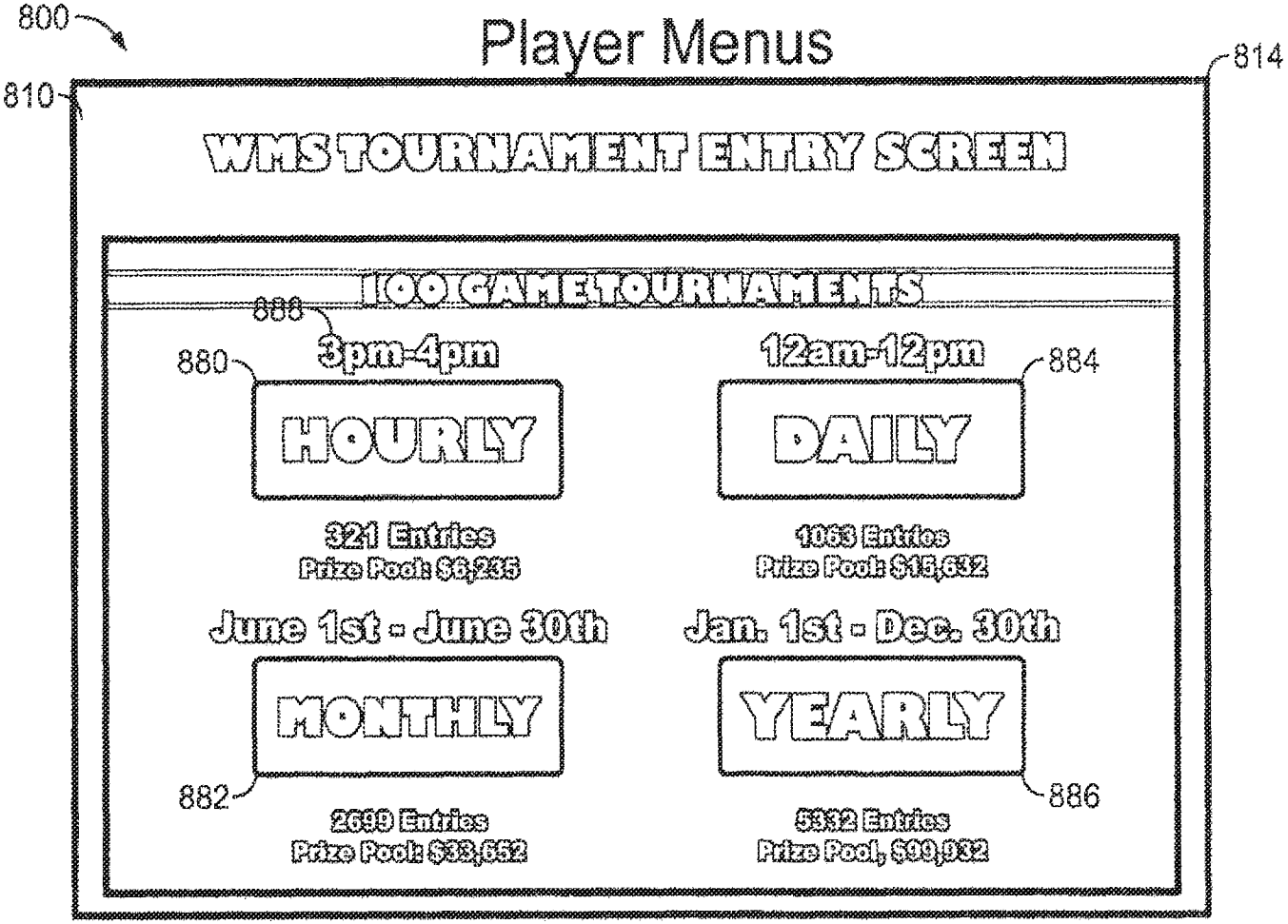
FIG. 8 is an image of a primary display of a gaming device displaying a variety of tournaments a player may enter.

In accordance with one embodiment of the present invention, tournaments are based on a predetermined number of games or plays of the primary wagering game—rather than traditional tournaments which are time based. Thus, for example, a tournament entry may comprise a series of 100 spins of a wagering game, and the player's results therein based upon the tournament points collected therein. When a player selects to play the wagering game in tournament mode, as seen in FIG. 7, he or she must then decide which tournament they will compete in (i.e. make a selection from available tournaments). Turning to FIG. 8, the primary display 814 of the gaming terminal 810 of the system 800 may change to display the available tournaments 880,882, 884,886 which are currently "open," active, or running. That is, the player may select from the available tournaments in which they would like to compete. In FIG. 8, for example, the tournaments 880,882,884,886 include an Hourly tournament 880, a Daily tournament 882, a Monthly tournament 884, and a Yearly tournament 886. Each tournament is open or active for the period of time associated with the tournament. One or more information displays 888 may display the dates and/or times during which the tournament 880,882, 884,886 remains open, as well as tournament status information such as number of entries and accumulated prize pool. In this example, the player selects the "Hourly" tournament which runs until the top of the hour. This means that the player has the remainder of the hour in which to complete his entry into the tournament (i.e. to play the requisite number of plays of the wagering game to form an entry into the tournament).

In another embodiment, the player is entered into the appropriate tournament once his entry is completed. For example, a player selecting an HOURLY tournament begins his play of 100 spins of the primary wagering game. As explained, the total tournament score he achieves after completion of 100 spins comprises his tournament entry. Assume the player commences play at 10:45 a.m. If he completes his entry (100 spins) prior to 11:00 a.m. (e.g. 10:52 a.m.), his tournament score is entered into the 10 AM-11 AM HOURLY tournament. If he takes a bit longer and completed his entry after 11:00 a.m. (e.g. 11:10 a.m.), his tournament score is entered into the 11 AM-12 Noon HOURLY tournament. Thus, in an embodiment, the player's completion time determines which tournament his score is entered into, and thus, which tournament(s) he participates in.

Figure 9:
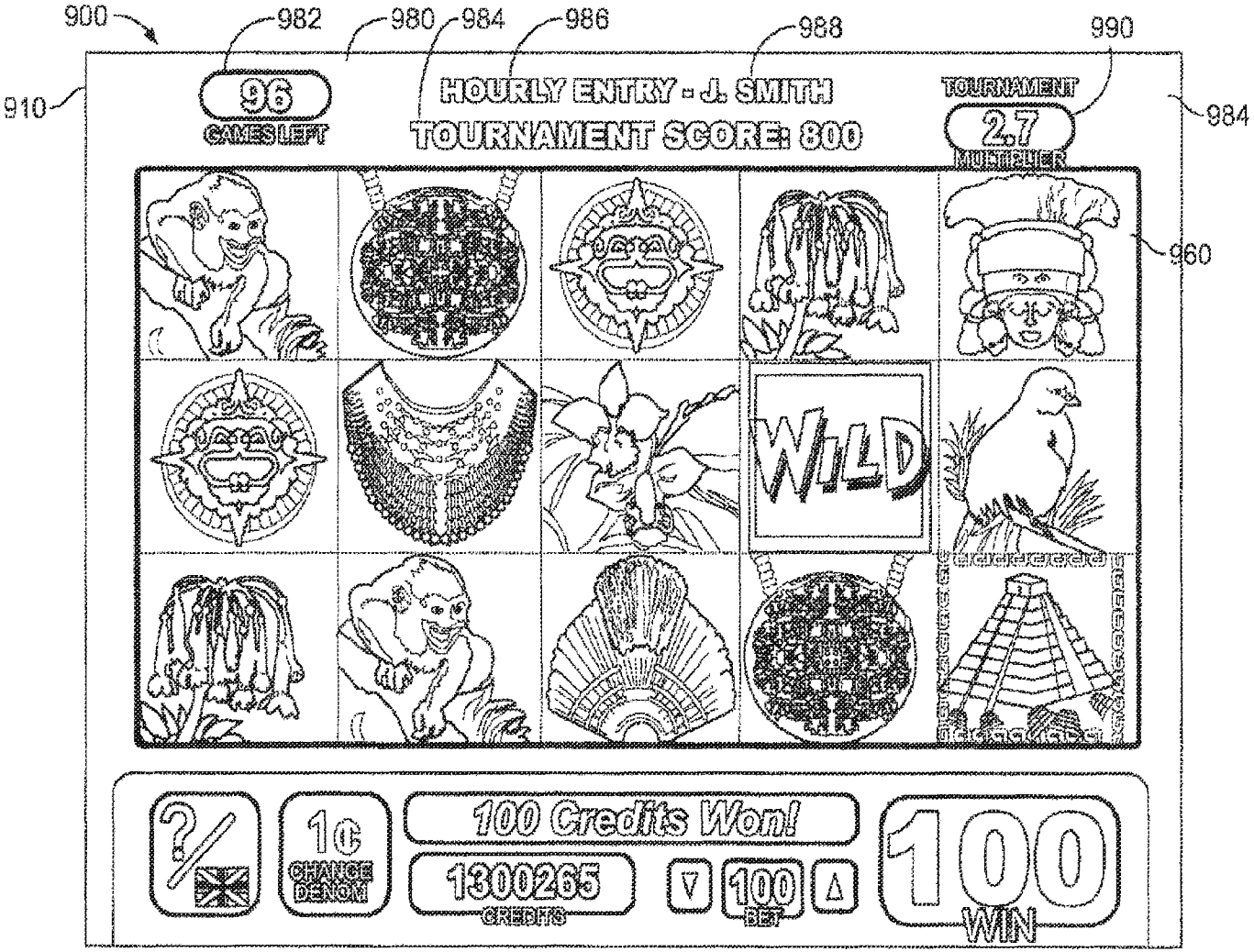
FIG. 9 is an image of a screenshot of a primary display of a gaming device displaying a primary wagering game in tournament mode.

Turning to FIG. 9, depicted is the primary display 914 of a gaming terminal 910 of the gaming system 900 during play of the wagering game 960 in tournament mode. In tournament mode, in addition to the wagering game 960, the primary display 914 includes a tournament information bar 980. The tournament information bar 980 displays tournament related information, and includes a game counter 982, a tournament score meter 984, a tournament identifier 986, a player identifier 988, and optionally, a tournament multiplier 990 as described herein. As seen, the selected "Hourly" tournament is displayed as the tournament identifier 986, which reads "Hourly Entry." Additionally displayed is the player's name (or other identifier) of "J. Smith" in the player identifier 988 field. In this embodiment, a tournament entry comprises a total number of points accumulated in 100 consecutive plays of the wagering game 960. Thus, the game counter 982 reflects that 96 games are remaining, meaning that the player has played 4 out of the 100 games or plays required to form a tournament score. The player's current tournament score is 800, as displayed in the tournament score meter 984.

While in tournament mode, the player plays the wagering game 960 in typical fashion—by entering wagers and pressing a spin button, for example, to initiate a play of the wagering game. A winning combination of symbols in a randomly selected outcome comprises a winning outcome for which credits are paid in accordance with a pay table. As seen in FIG. 9, a winning outcome has occurred and the player has won 100 credits. The bottom of the primary display 914 informs the player "100 Credits Won!" Because the base game return is reduced in tournament mode, the player's return from the base games will be less, on average, however, his overall return will not be affected as he will be participating in tournaments and thus will have an opportunity to win additional credits. In the base game, to effectuate the lower base game return, the game can be configured to play with either reduced frequency with which winning combinations occur, by reducing the awards associated with winning combinations, or both. In some embodiments, to keep the game's appearance consistent, the pay table is not altered, however, the frequency of wins is reduced.

However, in addition to earning credits for winning outcomes in the base game 960, each winning spin or play of the wagering game 960 also contributes tournament points to the player's tournament score 984, forming the player's entry into the current tournament (in this case the Hourly tournament). For the winning combination shown in FIG. 9, the player has received twenty (20) tournament points which are added to the tournament score 984 (bringing the tournament score balance from 780 up to 800 as displayed). The tournament points awarded for each win may vary amongst different wagering games 960, but can be equalized in accordance with a tournament score handicapping method described further herein. In an embodiment, each credit award in the pay table of the wagering game 960 is associated with a corresponding tournament point award which is provided to the player and added to their cumulative tournament score 984. The player continues playing the primary wagering game 960 until all 100 spins of the tournament are completed. At such time, the game counter 982 will reflect zero (0) games remaining and the player's tournament score 984 will be complete as a tournament entry and uploaded to the gaming system 900, where it is logged into a tournament server, for example, which collects player's scores, analyzes results and finishing orders, and provides awards accordingly. Thus, a player playing in tournament mode simultaneously accumulates traditional credit awards for winning combinations in the wagering game and also accumulates tournament points forming the player's tournament score or entry for an active tournament in which he is participating.

Figure 10:
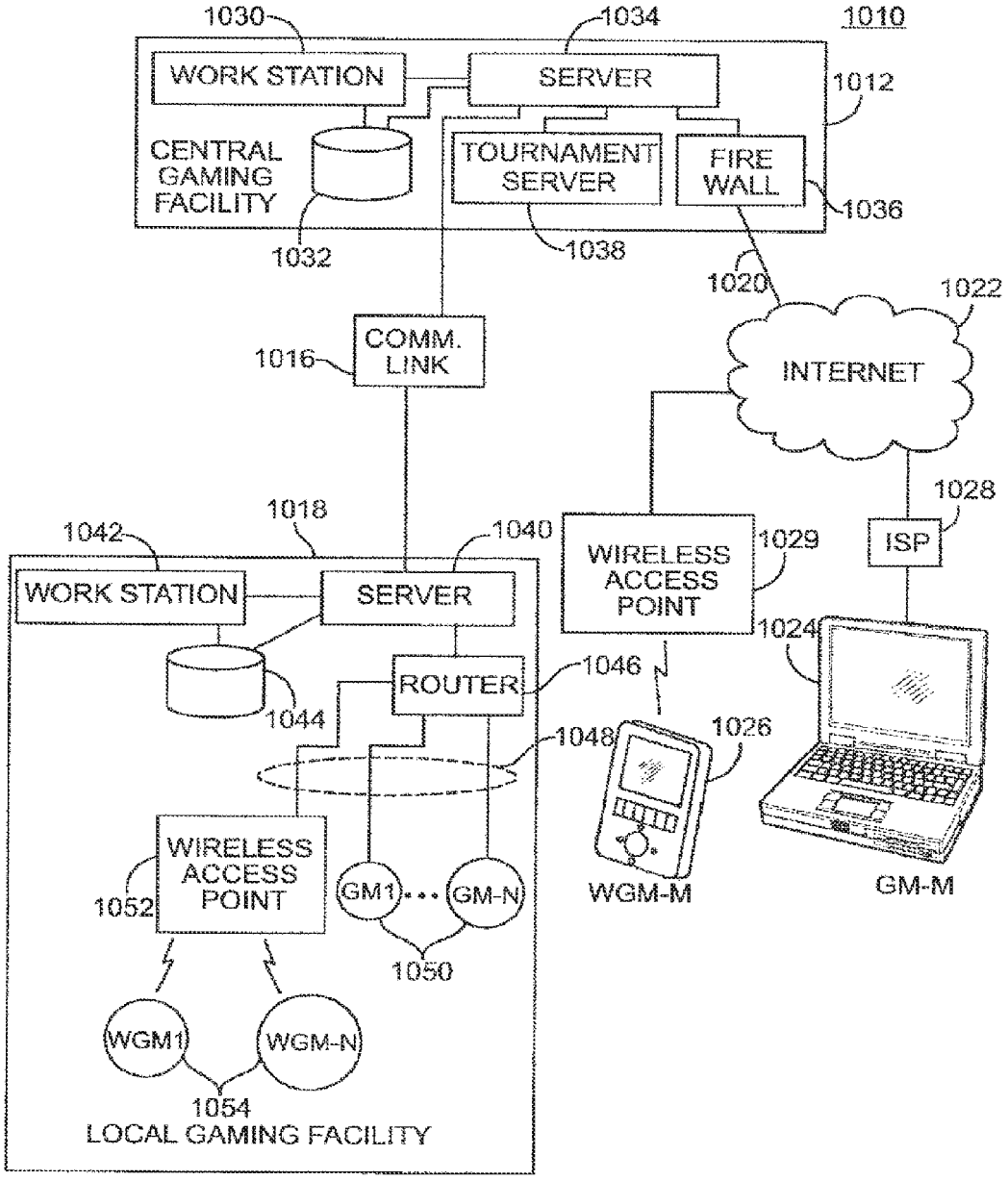
FIG. 10 is a diagram of an example gaming system including a tournament server for administering system wide tournament features.

Turning to FIG. 10, a diagram of an example gaming system 1000 having system-wide tournament features is depicted. Shown in FIG. 10, is an exemplary gaming system 1010 which includes a central gaming facility 1012 connected by communication link 1016 to a local gaming facility 1018 (e.g., a casino) and by link 1020 with the internet 1022. End-user computing devices including a gaming machine or terminal GM-M 1024 (e.g., a laptop computer) and wireless gaming machine or terminal WGM-M 1026 (e.g., a personal digital assistant (PDA)) function as clients of the central gaming facility 1012. Laptop 1024 is coupled via internet service provider 1028 and the internet 1022 with the central gaming facility 1012. The PDA 1026 is connected with a wireless link by the wireless access point 1029 and internet 1022 to the central gaming facility 1012. As used herein, "gaming" refers to the use of various games that support the placing of wagers on the outcome of the games (e.g., a video poker machine).

The central gaming facility 1012 may represent a control location of a gaming business operator that supports individual gaming users (e.g., users of PDA 1026 and laptop 1024) as well as other gaming facilities of the operator such as casino 1018. The central gaming facility 1012 in this illustrative example may be geographically separated from the casino 1018 and the individual users. The central gaming facility 1012 includes a workstation 1030 supported by data storage element 1032 and a server 1034 that serves as a communication host for casino 1018 and the individual users via a firewall 1036. Requests for information and/or data received from the individual users are processed by the server 1034. The requested information and/or data may be obtained from support resources (e.g., workstation 1030) and data residing in storage element 1032. The requested information is sent from the server 1034 to the requesting user's device(s).

The local gaming facility 1018 represents a casino and includes a server 1040 supported by a workstation 1042, data storage element 1044, and a router 1046. The router 1046 supports communications with different gaming machines or terminals GM(1)-GM(N) 1050 by wired links 1048. A wireless access point 1052 is connected by a wired link 1048 to router 1046 and by wireless communication links to wireless gaming machines or terminals WGM(1)-WGM(N) 1054.

At least some of the gaming machines 1050 and some of the wireless gaming machines 1054 support the play of wagering games in which the user's gaming machine functions in the client/server communication model with the user's gaming machine being a client of server 1040. The user's gaming machine contains software which is responsible for the ongoing play of the wagering game. However, some information or data associated with the play of the game may be obtained during the ongoing play of the game from server 1040. Thus, the gaming system 1010 displayed and described may be configured to execute and display a variety of primary wagering games and community or progressive wagering games on the terminals [GM(1)-GM (N) 1050, WGM(1)-WGM (N) 1054, GM-M 1024, and WM-M 1026], as explained further herein.

As seen in FIG. 10, the central gaming facility 1014 may also include a dedicated tournament server 1038. The tournament server 1038 may be separate from or integrated with the server 1034, or other servers of the facility 1012. The tournament server 1038 and/or workstation 1030 include software which operates to control, manage, execute, and operate the available tournaments as described herein. For example, such software may log in users to the system, detect and catalog their entries into various tournaments, collect all tournament entries for a particular tournament, create results based upon such entries, award awards in accordance with rule sets relating to finishing order in the tournament(s), and track player's progress through various tournaments. The tournament server 1038, for example, may permit players to access a player history file or profile to see past tournaments in which they competed, past results, etc. The tournament server 1038 may provide access to players within a casino or gaming facility over link 1016, or may otherwise provide access to players remote from the gaming facility, for example over a home or mobile computer via link 1020. It should further be understood that any of the functions described herein as relating to the central gaming facility 1012 may alternatively or additionally be performed at the local gaming facility 1018, or by any computer or server in communication therewith.

Figure 11:
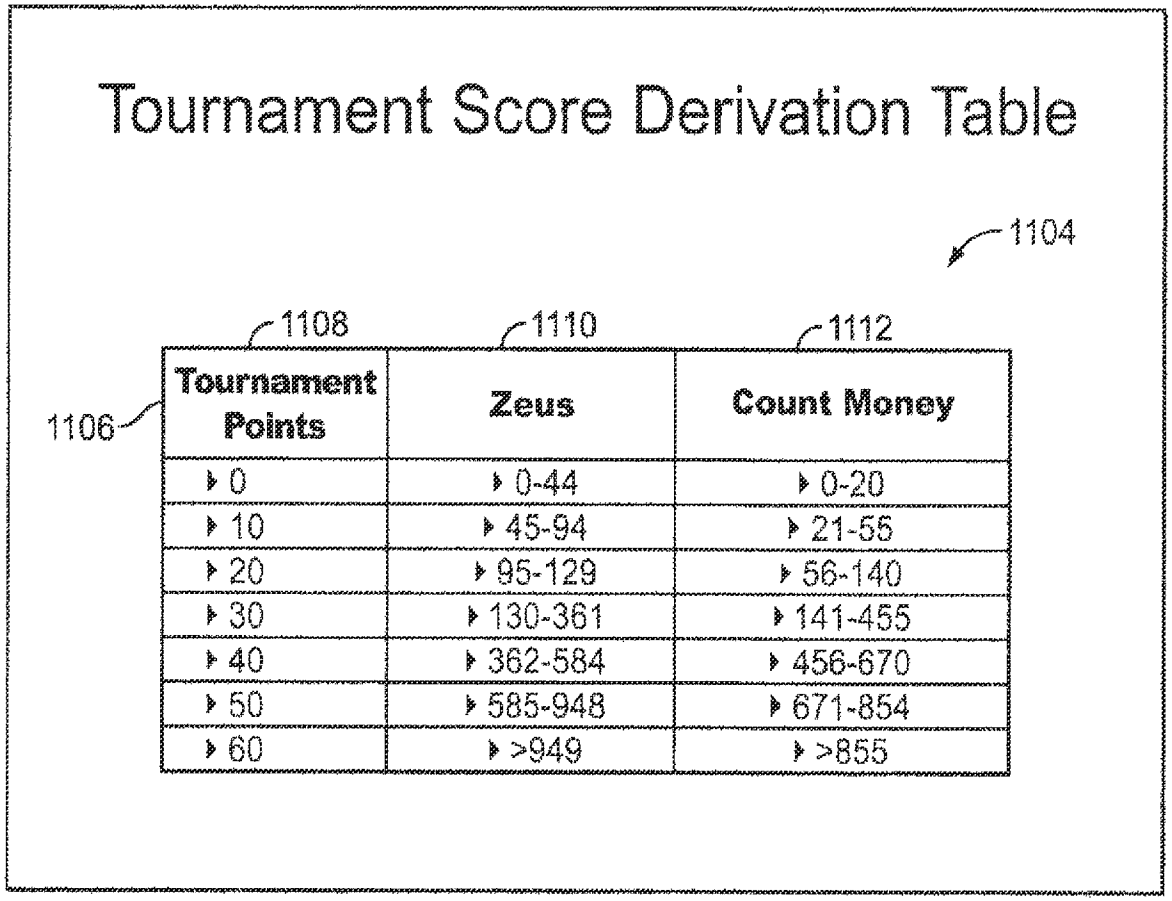
FIG. 11 is an image of a Tournament Score Derivation Table used to determine tournament point payouts for various credit awards paid out in a plurality of primary wagering games.

Turning to FIG. 11, a tournament score derivation table 1104 is depicted. The derivation table 1104 may be used to handicap or normalize the tournament points awarded during play of two different wagering games. Because different wagering games have different pay tables, pay line configurations, and awarding schemes, one or more tournament score derivation tables may be used to equalize the number of tournament points earned for a winning outcome in each such primary wagering game. Thus, for example, shown in the table 1104 are two primary wagering games: "Zeus" and "Count Money." The Zeus game has credit awards ranging from zero to 1500 credits, and includes thirty pay lines. The Count Money game has credit awards ranging from zero to 1200 credits, and has twenty five pay lines. Therefore, the table 1104 breaks up the two games into a plurality of ranges and associates each such range with a distinct tournament points score.

The derivation table 1104 contains tournament points awarded for a win that occurs when one betting unit is wagered on all possible pay lines. The top row 1106 of the table 1104 contains the heading title for each of the three columns 1108, 1110, 1112 of the table. A first heading title, "Tournament Points," heads the first column 1108. The entries contained in each row of the first column are the number of tournament points awarded for a particular game outcome. A second heading title, "Zeus," heads the second column 1110 of the table 1104. Entries contained in the second column 1110 are credit award ranges in the Zeus game which have been configured to correspond to and be associated with the tournament points contained in the first column 1108. A third heading title, "Count Money," heads the third column 1112 of the table 1104. Entries contained in the third column 1112 are credit award ranges in the Count Money game which have been configured to correspond to and be associated with the tournament points contained in the first column 1108.

As can be seen in FIG. 11, the Count Money game generally is a less volatile game than the Zeus game. Wagering games can have many different types of probability distributions that determine the size and frequency of wins. Equalization is desirable to ensure that a player playing the Zeus game is not unfairly competing in tournaments offered by the gaming system, vis-à-vis the player playing the Count Money game, and vice versa. Therefore, the entire credit award range of each game is broken down into ranges which correspond with a distinct set of tournament points 1108 available. For example, a player playing the Count Money game and achieving a one hundred thirty five (135) credit win is awarded twenty (20) tournament points on that play of the game, in accordance with the table 1104. However, a player playing the Zeus game and achieving a one hundred thirty five (135) credit win is awarded thirty (30) tournament points on that play of the game, in accordance with the table 1104. Thus, because the games have different ranges of credit awards available, each of the games' ranges are broken down differently in the table 1104 to ensure fairness and uniformity to players earning tournament points.

In the example, the less volatile Count Money game earns more tournament points for the lower and higher credit amounts that the more volatile Zeus game. However, the Zeus game earns more tournament points for the middle credit amounts than the Count Money game In this way, the tournament derivation table 1104 operates as a handicapping system to generate earned tournament points based upon a credit win's relative position in the range of available credit wins for a particular game. This creates a substantially equal chance for all players in winning a tournament based upon their entry collected regardless of which primary wagering game they played. In one embodiment, the tournament derivation table 1104 contains a column for each primary wagering game offered in the casino or operator's facility such that all such games can be equalized and cross referenced for generation of corresponding tournament points on winning spins or outcomes.

Figure 20:
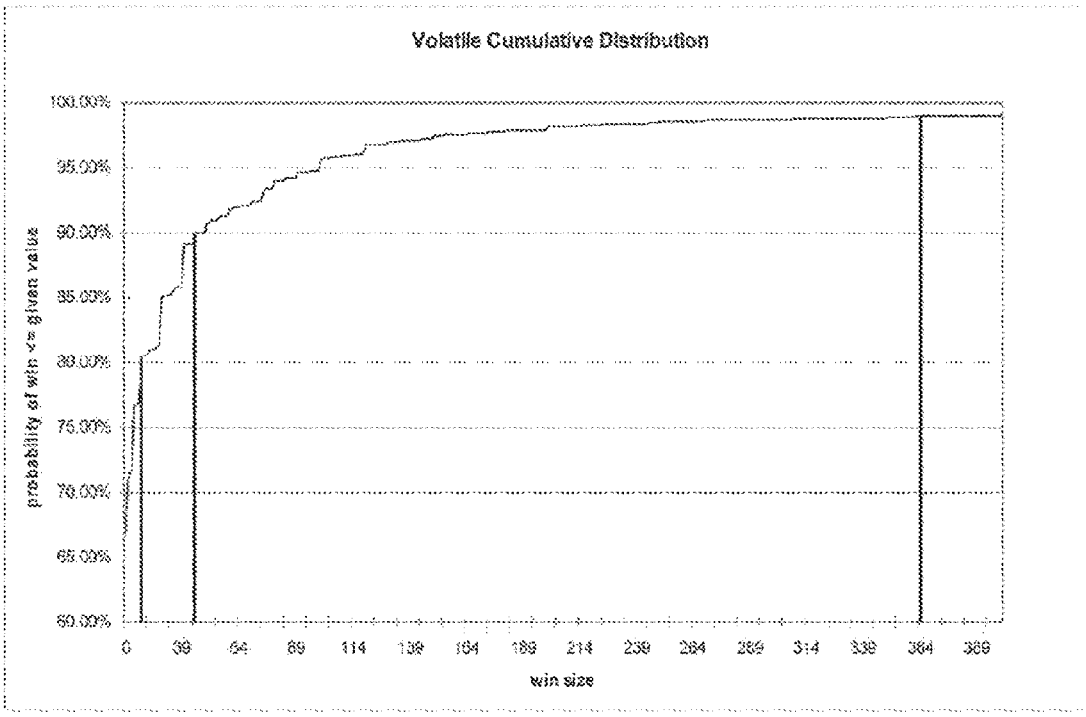
FIG. 20 is a table illustrating a cumulative distribution for a hypothetical volatile wagering game.
Figure 21:
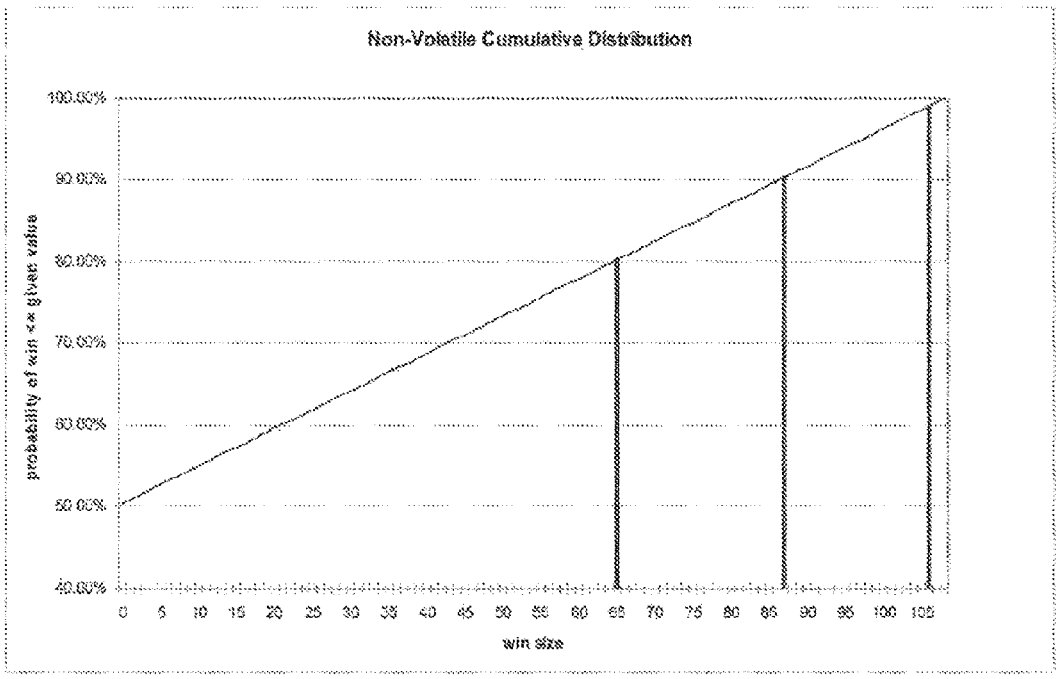
FIG. 21 is a table illustrating a cumulative distribution for a hypothetical non-volatile wagering game.

The tournament points to credit value association can be further understood with respect to Tables 1 (shown in FIG. 20), 2 (shown in FIG. 21), and 3 below. Table 1 in FIG. 20 illustrates a cumulative distribution for a hypothetical volatile wagering game while Table 2 in FIG. 21 illustrates a cumulative distribution for a hypothetical non-volatile wagering game. As can be seen in both Tables, the Y axis represents the likelihood of a win occurring and the X axis represents the win size. Thus, as can be seen, the higher the win size, the less the likelihood of such a win occurring. For example, with respect to Table 2 in FIG. 21, a winning outcome should occur 50% of the time, but only 5% of the time will an outcome exceed 106 credits. By analyzing and sub-dividing the cumulative distributions for various games, a tournament scoring system can be implemented that equalizes various wagering games and does not provide an advantage to any player no matter what wagering game the player chooses to play.

Table 3 provides a possible tournament points schedule with respect to the above-provided cumulative distributions.

TABLE 3

| Tournament Points | Volatile | Non-Volatile |
|---|---|---|
| 1 | 0-19 | 0-64 |
| 2 | 20-44 | 65-86 |
| 3 | 45-364 | 87-105 |
| 4 | ≥365 | ≥106 |

Each of the cumulative distributions in Tables 1 and 2 in FIGS. 20 and 21 respectively are divided into quartiles (though any distribution could be divided into any number of sections), and each quartile is then associated with a number of tournament points. For example, in both the non-volatile and volatile game, a player receives a single tournament point for 80% of the handle pulls. However, the credit values associated with that one point varies. In the volatile game, a win of 19 credits or less occurs 80% of the time whereas in the non-volatile game, a win of 64 credits or less occurs 80% of the time. Thus, even though the players are winning different credit amounts with respect to the game they are playing, their tournament points and scoring has been equalized across various games. The method for equalizing various wagering games is more fully detailed below.

Referring again to FIG. 11, in looking at the mathematics behind constructing the Tournament Score Derivation Table 1104 it is worth noting that the possible outcomes of a slot spin form a discrete probability distribution. For each integer $k \geq 0$, $p_k$ is defined as the probability that a spin wins k credits, where:

$$p_0+p_1+p_2+\ldots=1$$

The cumulative distribution function F(n) may be defined as follows:

$$F(n)=p_0+p_1+\ldots+p_n$$

In other words, F(n) is the probability that a slot spin pays less than or equal to n credits. We also define $F(-1)=-1$.

Suppose we wish set up a tournament such that each spin awards N distinct levels of points $A_1, A_2, \ldots, A_N$ and the corresponding probabilities of being awarded these point levels are given by $q_1, q_2, \ldots, q_N$, respectively. We assume that $q_k>0$ for each $1 \leq k \leq N$ and $q_1+\ldots+q_N=1$. What follows is an algorithm using the cumulative distribution function to obtain a slot tournament with the desired properties.

Define the cumulative distribution function for the $q_i$'s:

$$Q(0)=0$$

$$Q(k)=q_1+\ldots+q_k, 1 \leq k \leq N$$

Obtain N (uniquely determined) integers $0 \leq n_1 \leq n_2 \leq \ldots \leq n_N$ with the following properties for each $1 \leq k \leq N-1$:

$$F(n_k) \geq Q(k)$$

$$F(n_k-1)<Q(k)$$

In the previous two formulas $F(n_k)$ is the probability that a given slot spin pays less than or equal to n credits. A $q_k$ of Q(k) is the probability of being awarded tournament points at less than or equal to the $k^{th}$ point level, where a point level corresponds to a row in the Tournament Score Derivation Table 1104. In other words, we are looking for an n such that the probability that a slot spin pays less than or equal to n credits is greater than or equal to the probability of being awarded a tournament point level k $[F(n_k) \geq Q(k)]$. And the probability that a slot spin pays less than or equal to n−1 credits is less than the probability of being awarded a tournament point level k. In looking at the Zeus column 1110 of the Tournament Score Derivation Table 1104, $n_1$ is 44, $n_2$ is 94, $n_3$ is 129, $n_4$ is 361, etc. As to tournament point levels associated with the Zeus game, $q_1$ is 0, $q_2$ is 10, etc.

If $F(n_k)=Q(k)$ for each k, then the following award schedule has the desired properties. Let S be the number of credits won during a slot spin. Award tournament points according to the following formula:

$$A_1 \text{ if } S \leq n_1$$

$$A_k \text{ if } n_{k-1}<S \leq n_k \text{ and } 2 \leq k \leq N-1$$

$$A_n \text{ if } S>n_{N-1}$$

In relating the previous formulas to the Tournament Score Derivation Table 1104, $A_1$ corresponds to an award of 0 tournament points, $A_2$ corresponds to an award of ten tournament points, etc. Thus a player playing the Zeus game in a tournament is awarded point level $A_1$, which corresponds to zero points, if the number of credits won during a spin (S) is less than or equal to 44 (n1). A player is awarded point level $A_2$ if the number credits won during a spin (S) is greater than 44 ($n_1$) and less than or equal to 45 ($n_2$) where k is always greater or equal to 2.

The discrete nature of a slot distribution means that the condition $F(n_k)=Q(k)$ will not always be satisfied. This can be handled by means of a "tournament booster." The player is awarded tournament points according to the above formula. On random spins additional tournament points will be awarded. This is to assure that the probability a player is awarded $A_k$ tournament points is exactly $q_k$.

The gaming system(s) described herein may utilize a Player Return Formula to calculate the amount of a player's win based upon their finishing order in a particular tournament. In one embodiment, the player return formula comprises:

$$\text{Payout}=PP \times N \times (G \times AB) \times T\%$$

In the Player Return Formula, PP is the proportion of prize that the player wins, N is the number of players competing in the tournament, G is the number of games required for an entry into the tournament, AB is the average bet for the spins for such entry, and T is the tournament percentage return. Thus, in an example, assume a player named Larry is involved in a seventy two (72) player tournament. The tournament required an entry to be 100 games (or plays) of the base game, as described herein with reference to FIG. 9. Larry's average bet is $1.50. The tournament return percentage is 9%, as described in reference to FIG. 9. Assume Larry comes in second place in the tournament, which awards 20.5%. Thus, using the player return formula, we can calculate Larry's win:

$$\text{Payout}=PP\times N\times(G\times AB)\times T\%=20.5\%\times 72\times(100\times \$1.50)\times 9\%=\$199.26$$

Thus, Larry is awarded $199.26 for finishing second place in such a tournament. In FIG. 12 is shown an example prize proportion table 1202 that may be used in an embodiment, in conjunction with the player return formula to calculate an award that is awarded to a tournament participant. In an embodiment, the table 1202 contains prize proportion (PP) values that may be used in the player return formula 1202 to calculate a player's return. A prize proportion may be determined from the prize proportion table 1202 based on the finishing position of a tournament participant (left hand column) and the number of players in the tournament (top row). Thus, in the example above, Larry finished second in a seventy two person tournament. By cross-referencing the second finishing position (second row) with the seventy two person tournament (last column), it is seen that 20.5% is the appropriate payout percentage (PP) to be used in the player return formula.

In the gaming system(s) described, all tournament awards won by the various entrants into the tournaments available are provided via the player return formula. However, even though the prizes or awards are actually calculated using the player return formula, players may be more familiar with a "prize pool" concept. Thus, an alternative presentation technique may be employed which utilizes a Prize Pool and a Tournament Multiplier, as referenced in FIG. 9. In such an embodiment, a prize pool formula is used, albeit for presentation purposes only.

In such embodiments, the following prize pool formula may be used:

$$\text{Prize Pool}=N\times(G\times BB)\times T\%$$

In the prize pool formula, N equals the number of players involved in the tournament, G is the number of games required for an entry into the tournament, BB equals the base bet, or minimum bet permitted on a play of a wagering game for eligibility into the tournament, and T is the tournament percentage return. Thus, using the example above for the tournament in which Larry is competing in, the tournament is a 72 person tournament for 100 games. Assume that the eligibility requirements call for a player to make a minimum wager of at least $0.30 on each spin or play of the wagering game in order to earn tournament points and create a tournament entry. Therefore, the prize pool can be calculated using the prize pool formula above:

$$\text{Prize Pool}=N\times(G\times BB)\times T\%=72\times(100\times \$0.30)\times 9\%=\$194.40$$

This creates a "prize pool" based upon the minimum wager amount, since the operator can be assured that all players will be betting at least the minimum required amount. This prize pool amount can be used to promote the tournament, and can be displayed to players competing in the tournament. In addition to the prize pool amount, however, players participating in the tournament and making wagers greater than the minimum wager will be creating and enhancing a Tournament Multiplier, as described in FIG. 9. The tournament multiplier will increase as more higher (non-minimum) wagers are made, and will be utilized in increasing the player's ultimate payout in a tournament.

Figure 13:
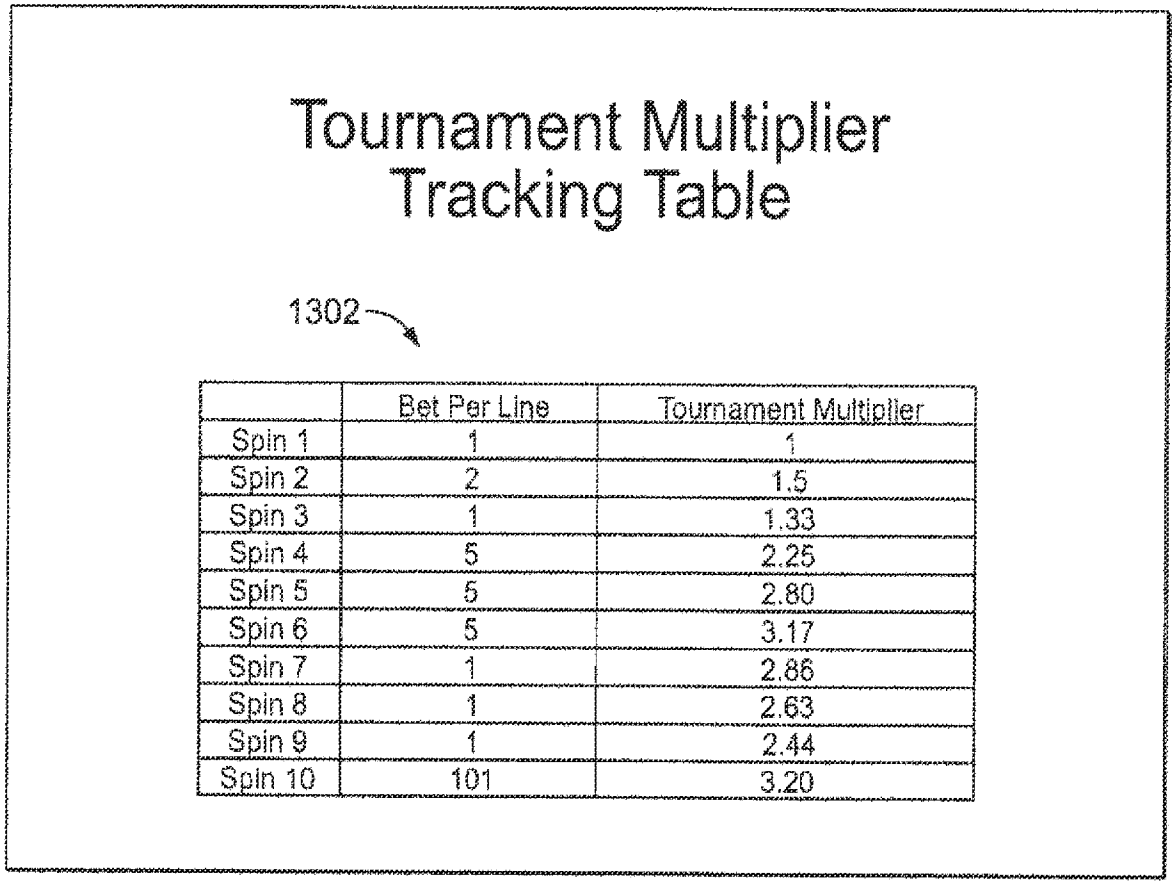
FIG. 13 is an image of a Tournament Multiplier Tracking Table showing an example calculation of a player's tournament multiplier as a function of that player's wagers.

Shown in FIG. 13 is an example Tournament Multiplier tracking table 1302. In such example, assume that the minimum wager is one credit per line. Thus, some embodiments may have a requirement that all pay lines be wagered upon. When a player is playing in tournament mode, a tournament multiplier tracking table may be activated in memory of the gaming system to track the player's tournament multiplier which is presented to them on the display, as seen in FIG. 9. Upon commencement of play in tournament mode, the player's tournament multiplier begins at one (1×). On the first spin, in this example, the player makes only the minimum wager on the wagering game, one credit per line, as seen in the second column of the table. Thus, the player's tournament multiplier remains at one. On the second spin, the player doubles his wager to two credits per line. Thus, the tournament multiplier increases to 1.5×. The tournament multiplier is cumulative of all spins, and is a function of how much the player's wager exceeds the minimum bet.

On the third spin, the player has made a minimum wager again, and his net tournament multiplier has dropped to 1.33×. On the fourth spin the player increases his wager to five times the minimum bet, and his tournament multiplier increased to 2.25×. At the conclusion of all ten spins, the player's tournament multiplier is 3.20× This tracking continues until the player has completed all of the games required for an entry into the tournament, for example, the 100 games required in the examples herein. At the conclusion of all 100 games, the player's tournament score is complete, and his net tournament multiplier tracked by the table is displayed to him on the display, as seen in FIG. 9. In an embodiment, the tournament multiplier is a function of the player's average bet per line for all spins executed in a tournament by a player. Thus, as seen in FIG. 13, over the course of ten spins, the player has wagered thirty two (32) credits per line (summing up the Bet Per Line column of the table). Dividing this number by the number of spins (10), yields the net tournament multiplier of 3.20×.

The prize pool formula and tournament multiplier may be used to calculate an individual player's award in the tournament. For example, in Larry's example tournament herein, Larry finished second place in a 72 person tournament, which pays out 20.5% for such a finish (in accordance with the prize proportion table 1202). Larry's average bet (AB) was $1.50 which is five times larger than the minimum or base bet (BB) of $0.30. Thus, at the conclusion of 100 games, Larry's tournament multiplier is 5×, as tracked in his tournament multiplier tracking table.

Recall that the prize pool was calculated above to be $194.40 using the prize pool formula. Larry's second place finish out of 72 players entitles him to 20.5% of the prize pool, which is $39.85. However, this individual win is further multiplied by Larry's tournament multiplier to compensate Larry for making bets in excess of the minimum wager. Thus, Larry's portion of the prize pool ($39.85) is multiplied by his tournament multiplier (5×) to arrive at Larry's award, which is $199.26. As can be seen this award of $199.26 is the same as that arrived at by using the player return formula above. Thus, the prize pool formula, based upon a minimum wager or base bet (BB), arrives at the same result as the player return formula, based upon an average bet (AB), because of the application of the player's tournament multiplier. This is because the tournament multiplier is dependent upon tracking of how much the player's actual wagers exceed the base bet.

Turning now to FIG. 14, displayed is a chart 1402 of an example accounting of a tournament conducted by the gaming system(s) described herein. In one embodiment, the information displayed in the example accounting chart 1402 is the information that is tracked for one tournament. The chart 1402 and information contained therein, are stored in a central computer, for example the tournament server of FIG. 10, that is part of the gaming system. In this embodiment, the information tracked includes a tournament number 1404, a number of entries in a tournament 1406, a number of games comprising an entry into the tournament 1408, base denomination wagered 1410, a base bet or wager 1412, the tournament return 1414, a tournament fee 1416, a prize pool 1418, finishing positions 1420, payout percentages 1422, tournament multipliers 1424 for each finisher, a total payout 1426 for each finisher, a total outlay 1428, a total income 1430, a net revenue 1432, and an average player multiplier 1434.

In some embodiments, the tournament number 1404 is a number that uniquely identifies a tournament. The number of entries 1406 is the number of players entered into the tournament (e.g., 72). The number of games 1408 in the tournament is the number of spins a player performs to create an entry into the tournament (e.g., 100). The tournament return 1414 is 9% and the tournament fee is 1%, as described with reference to FIG. 9. The Prize Pool 1418 is the Prize Pool calculated by using the prize pool formula herein (e.g., $194.40). The payout percentage 1422 is taken from the appropriate prize proportion table (e.g., the table 1202 of FIG. 12), which indicates the percentage awarded to each player based upon number of players and finishing order. The number of finishing positions 1420 is also taken from such table. The tournament multiplier 1424 is collected from the various tournament multipliers calculated for the players in the finishing positions 1420, as discussed herein. The total payout 1426 for each player is the award awarded to each player in one of the finishing positions 1420. As discussed before, it can be derived from the player return formula or the prize pool formula as described.

The average player multiplier 1434 is the average multiplier for all players participating in a tournament, and is tracked so that an operator may see how players as a whole are wagering in comparison to the minimum wager or base bet. The total outlay 1428 is the sum of all of the payouts 1426 paid to the finishing players in the tournament, and thus comprises a total amount awarded for a tournament. The total income 1430 is the total amount of money wagered by players participating in a tournament in creating their tournament entries. The net revenue 1432 is the total income 1430 minus the total outlay 1428. Thus, as seen in FIG. 14, in some tournaments, the net income is negative, meaning the casino or operator paid out more awards to the players than collected from the participants in the tournament. This may occur from time to time. However, over time, the net income will on average be positive. This is because the net expected value (the base game return 80%, plus the tournament return 9%, plus the tournament fee 1% of 90%, for example, will on average yield a profit over time.

When only a few players are involved in a tournament, player collusion could affect the tournament outcome. To ensure collusion does not affect a tournament outcome, a minimum number of participants may be required for a tournament to begin or run. In one embodiment, the minimum number of players is ten. If a tournament does not proceed due to insufficient number of entries, players that entered the cancelled tournament are refunded the expected value of their tournament entry. It should be understood that a player's completion of his or her entries into a tournament need not be accomplished at once, or even in one gaming session. In an embodiment, players may leave play of a gaming device and return at a later time to complete the remainder of their tournament entry. In some embodiments, it may be required that all spins or plays of the wagering game comprising the tournament entry be completed during an active period for the tournament, for example, during the hour for an hourly tournament or by the end of the day for a daily tournament.

Figure 15:
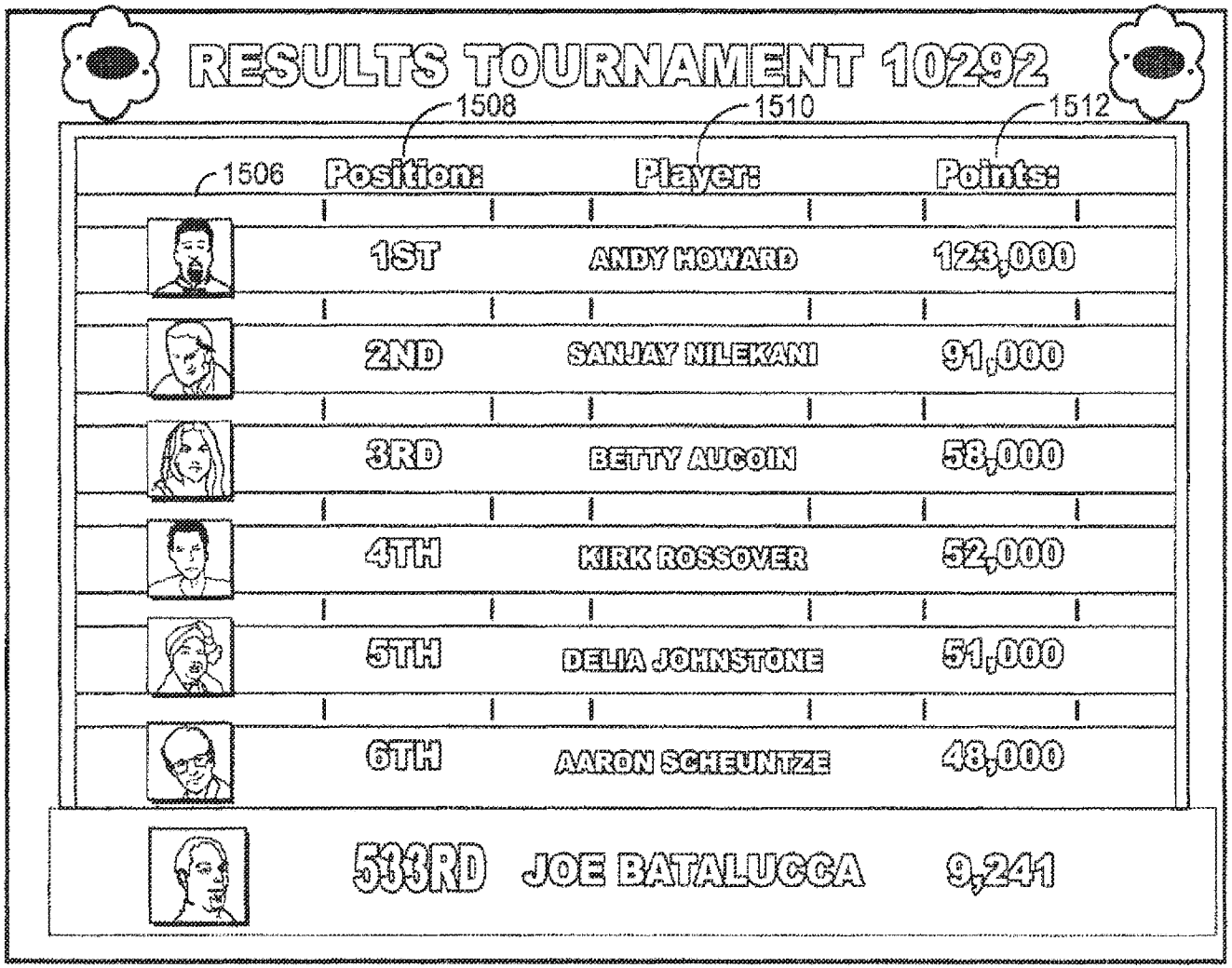
FIG. 15 is an image of an example Tournament Results Table.

Using the gaming system(s) described herein, players may access tournament results. For example, using any of the remote computing devices in the system of FIG. 10, players can gain access to information stored on the tournament server therein. Turning to FIG. 15, depicted is an example results table 1502 of a completed tournament stored in memory of the gaming system, for example on such a tournament server. In the embodiment depicted, the results table 1502 is comprised of a tournament number 1504, a column displaying players images 1506 (which could a photograph, avatar, or any other graphic selected), a column displaying players finishing positions 1508, a column displaying players names 1510 (or perhaps other identifiers, such as screen names) and a column displaying a number of tournament points achieved 1512. Additional information, such as payouts and awards may be displayed in alternative embodiments. In some embodiments, when registering for a tournament a player may select custom options such as a screen name and an avatar. In the embodiment depicted, the screen name and avatar are displayed in the result tables. As shown in the example display, a player's avatar, finishing position, player name and points awarded are displayed in the same row.

In the example shown in FIG. 15, the player named Joe Batalucca has logged in to check his performance in tournament number 10292. As a result, the logged in player's name and results are highlighted by a box around the row containing his information. As seen, Joe Batalucca has finished in 533$^{rd}$ place for his entry in which he accumulated 9,241 tournament points. Also displayed are Joe Batalucca's name 1510 and image 1506. The results table 1502 may be displayed in many places. One aspect of the gaming system (s) described herein is that a player may be able to check tournament scores in any number of places regardless of where the tournament is played. Thus the table may be displayed on a primary gaming screen, a secondary gaming screen or on a public display inside a casino. Alternatively, the display may be accessible via the Internet or downloadable to a communication device such as an personal digital assistant. The gaming system of FIG. 10, for example, permits such remote and varied access to such information.

Figure 16:
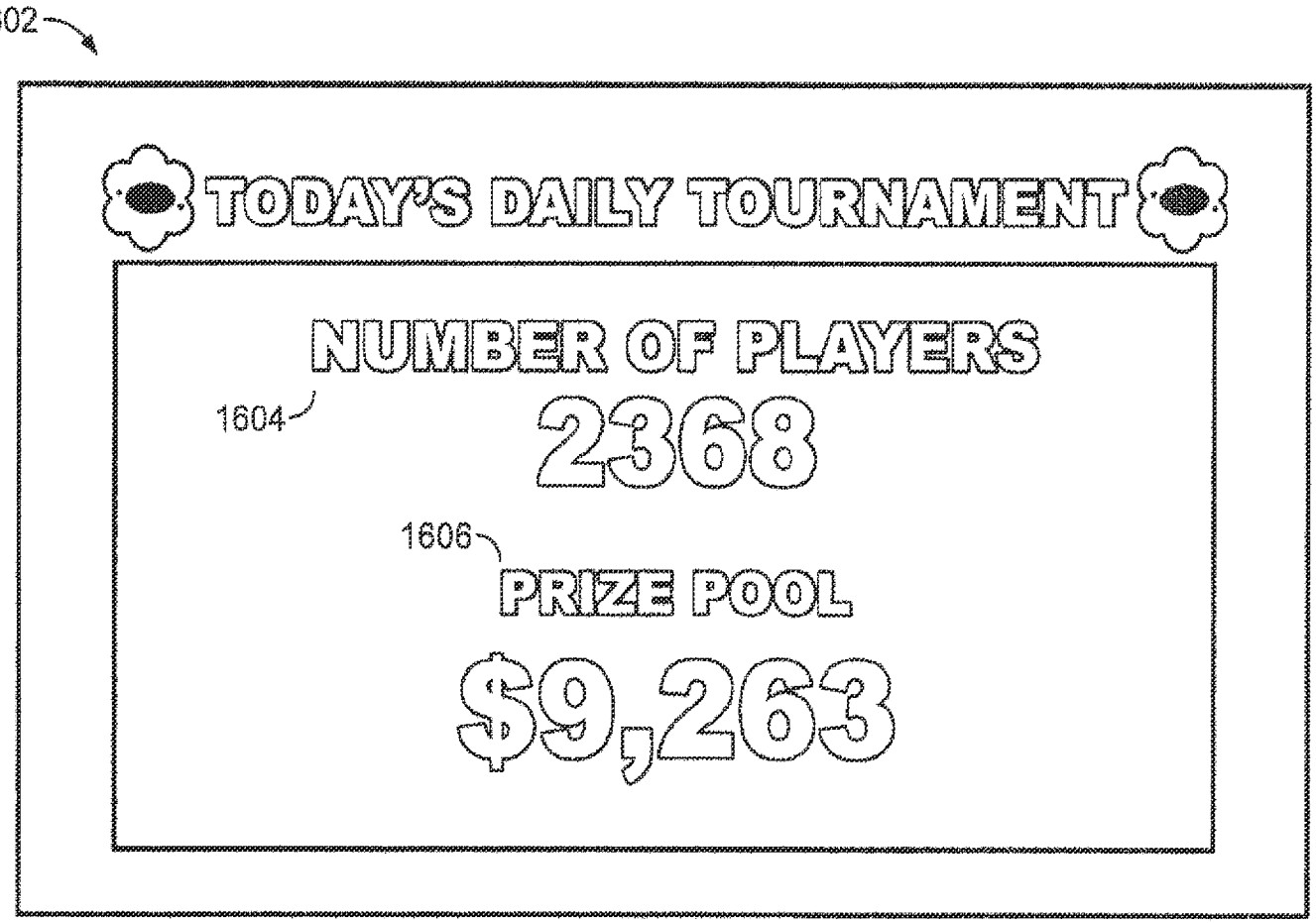
FIG. 16 is an image of tournament information display.

Other information may also be accessible by such players. For example, turning to FIG. 16, another example tournament information display 1602 is shown. In some embodiments, the information display 1602 displays information concerning tournament information, such as number of players and prize pool, which may be of interest to a player contemplating joining or entering a tournament, or seeing past results of a completed tournament. In an embodiment, the display displays a number of players field 1604 and a Prize Pool field 1606. In the example depicted, the number of players involved in the tournament is two thousand three hundred and sixty-eight and the prize pool is nine thousand two hundred and sixty-three dollars. The prize pool 1606 is calculated in accordance with the prize pool formula described herein.

In accordance with one embodiment, gaming systems offering system wide tournament features keep player's entries, progress, and results private from other players until a tournament is completed. Keeping scores private while a tournament is in play ensures that others will not be discouraged from entering the tournament because a player participating in the tournament has posted a high score. Furthermore, it ensures the fairest outcome for all players. Thus, in an embodiment, while a tournament is ongoing, the only information displayed in a tournament information display 1602 is the number of players participating in the tournament and the prize pool. This may incentivize others to join the tournament due to the perceived popularity of the tournament.

Figure 17:
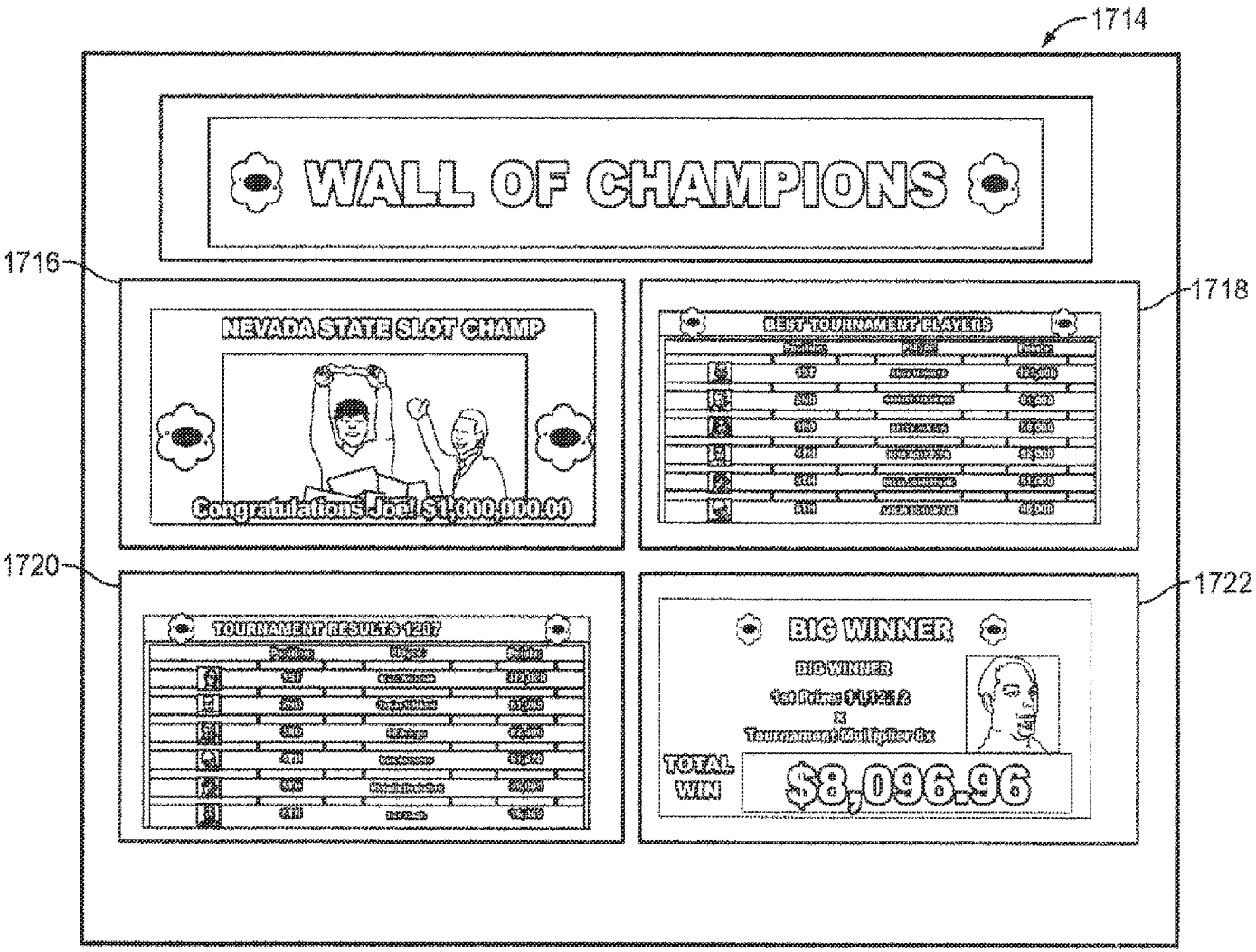
FIG. 17 is an image of a Wall of Champions display.

Yet other information accessible by players may include a Wall of Champions, such as that displayed in FIG. 17. Because tournaments conducted on such gaming systems described herein are not conducted in real time (simultaneous play of all players), it is vital that players be able to access tournament results as easily and conveniently as possible. One way a player may access tournament results is by viewing the Wall of Champions display 1714. In an embodiment the Wall of Champions display 1714 contains screens which communicate information such as a championship winner 1716, the a list of the best tournament players 1718, the results of a particular tournament 1720 and a "Big Winner" winner of a tournament 1722. In an embodiment, the "Big Winner" of a tournament is a player who is awarded the largest award in the tournament, even if that player did not finish in first place. This may occur, for example, if a lower finishing player had a larger tournament multiplier so as to achieve a larger individual payout, in accordance with the prize pool and player return formulas.

The Wall of Champions display 1714 may be displayed publicly in a casino or on gaming devices therein, so as to allow a players to view such information. Players listed on the Wall of Champions may be able to experience a sense of pride by "seeing their name in lights" or otherwise enjoy bragging rights associated with their accomplishments. Additionally, or alternatively, the Wall of Champions may be accessible over the Internet, or downloaded to a personal communication device, in accordance with the abilities of the gaming system. Alternatively, the Wall of Champions display 1714 may be displayed in a primary or secondary display of a gaming machine when a player logs into the system, or the display 1714 may be displayed in a primary or secondary display of a gaming machine if a tournament finishes while a player is still playing (for example as a pop up screen upon tournament completion). Regardless of how the Wall of Champions is displayed, it provides players with easy access to the results of a tournament.

Figure 18:
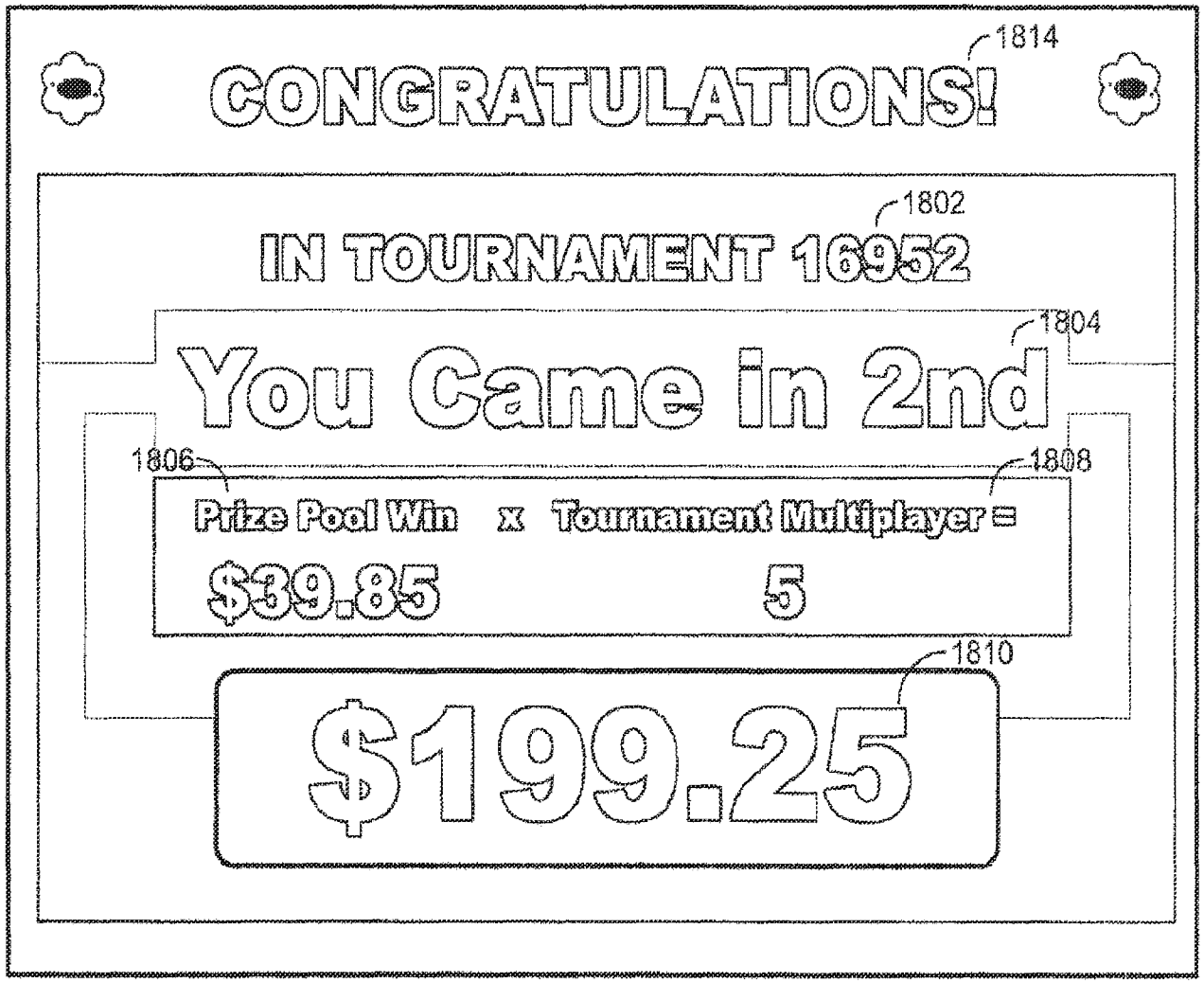
FIG. 18 is an image of a primary display of a gaming terminal displaying an individual player's results.

Yet another information display utilized by the gaming system(s) herein may include a results display, such as the results display depicted in FIG. 18. This example results display 1814 contains the results of an individual player's performance while participating in a tournament on the gaming system. In response to a triggering event, the results display 1814 may be provided to the player. For example, upon the conclusion of the relevant tournament, the results display 1814 may pop up on a gaming device in which the player is logged in or registered so as to automatically communicate the results thereof to the player. In other embodiments, the results display 1814 may be retrieved by the player in any of the number of ways described herein with reference to other tournament information. In the embodiment depicted, the results communicated to the player in the results display 1814 include a tournament number 1802, the player's finishing position 1804, the portion of the prize pool awarded to the player 1806, a tournament multiplier 1808 and a total award awarded to the player 1810.

Figure 19:
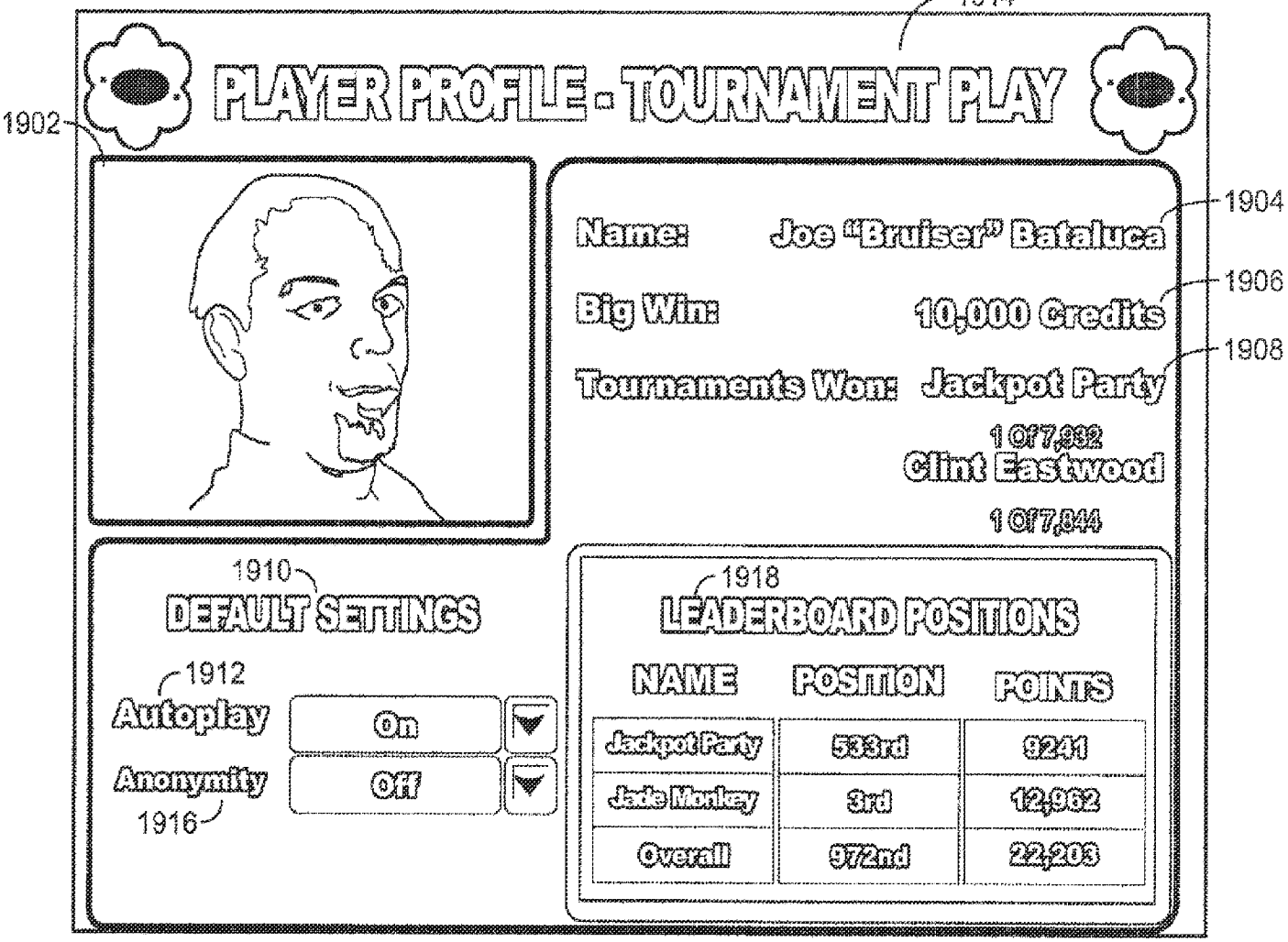
FIG. 19 is an image of an example player profile display accessible by a player to be viewed on a primary display of a gaming terminal.

Turning now to FIG. 19, yet another information display accessible to players includes a player profile display 1914 that displays a player's performance information. The player profile display 1914 may be used to notify a player about the player's tournament performance, a player's default settings, and leader board positions. In an embodiment, a portion of a player profile display 1914 may display a player image 1902. The image 1902 may be a picture, photograph, avatar, or any other graphic or design chosen by the player or assigned by the operator. In some embodiments, the player profile display 1914 displays a player's screen name 1904 along with past tournament information, such as, a "Big Win" 1906 (the player's biggest win to date) and "Tournaments Won" 1908. In the example depicted, the displayed screen name is "Joe 'Bruiser' Batalucca." The "Big Win" 1906 may be a largest number of credits the player was awarded in a tournament. In this example, the largest previous award awarded to the player is a ten thousand credit award. Further, the tournaments won field 1908 shows that the player in this example previously won a "Jackpot Party" tournament and a "Clint Eastwood" tournament.

In the embodiment depicted, a portion of the display 1914 displays default settings 1910 the player may adjust for tournament play. In an embodiment, the player may be able to set an autoplay setting 1912 and an anonymity setting 1916. If the autoplay setting 1912 is enabled, a player may permit the system to autoplay a tournament for him. This, for example, may cause any gaming terminal in which the player is logged in to default to "Tournament Mode" rather than "Cash Mode" when available. The player may then check the results remotely. The anonymity setting 1916 may allow a player to keep portions of his profile anonymous. For example, a player may want to keep his avatar and/or screen name anonymous. If a player chooses to remain anonymous, a generic marker may be displayed in place of a player's avatar or name.

In some embodiments, a portion of the display displays the player's Leaderboard Positions 1918. In the embodiment depicted, whenever a tournament in which the player was competing is completed, the tournament information (such as finishing position and tournament points earned in his entry) are logged in the players' Leaderboard 1918. This way a player may track his performance in a plurality of tournaments at one time. A major factor behind maintaining a Leaderboard is player prestige. Players with the greatest skill levels are recognized with higher Leaderboard standings. Furthermore, Leaderboards help build a community experience and a sense of loyalty with Winners Network Tournaments.

In some embodiments prizes are offered for Leaderboard achievements. For example, yearly, monthly and weekly prizes may be offered for placing high on a Leaderboard. Also, prizes may be awarded for reaching a set number of Leaderboard points for a year. For example, a prize may be awarded for reaching one thousand, five thousand, and ten thousand Leaderboard points. Furthermore, a Lifetime Achievement award may be awarded when a player reaches one million Leaderboard points.

In some embodiments, Leaderboard points may be awarded based on the following formula:

$$P=8*SQRT(N/R)*(\mathrm{Log}(C+3))$$

In such formula, "P" is the number of Leaderboard points awarded. The players rank in the relevant tournament is represented by "R." The number of players in the tournament field is represented by "N." The base bet wagered in the tournament is represented by "C." 'SQRT(N/R)' weighs a player's performance by how well the player finished. The SQRT flattens the effect on the size of the field. Thus, finishing first in a one hundred player field is not ten times better than finishing first in a field of ten. Flattening the effect of the size of the field also flattens the volatility of results and keeps Leaderboard standings close. Log(C+3) weighs a player's performance by the cost of the event. The Log function flattens the effect of the cost. Thus, a one hundred dollar event does not result in a ten times better relative leader board position than a ten dollar event. The logarithmic function makes the one hundred dollar event two times better than the ten dollar event. Adding three to the variable C ensures that the result of Log(C+3) is always greater than one, even for a free event.

In an alternative embodiment, a tournament may have autoplay capabilities. A player may set up autoplay capabilities from a kiosk. Once autoplay capabilities have been set up, the tournaments may be automatically played by the system, for example, even while the player is not at a casino. The player can remotely follow autoplay results on the Internet, or by accessing information through other gaming devices.

In still another embodiment, the tournament is played over an entire jurisdiction, with entries being made jurisdiction wide. This may entail players entering a tournament from different casinos. Alternatively, players may enter a tournament at a KIOSK or other remote locations and either autoplay the tournament, or play the tournament at a casino at a later time. A player may additionally enter a tournament on-line. Regardless of the method a player chooses to enter a tournament, scores are maintained on a computer of the gaming system, for example the tournament server of FIG. 10. The player may monitor tournament results remotely using the Internet or other means of remote communication. The capabilities of the system may vary based upon the components and configurations of the hardware and software therein.

In yet another alternative embodiment, the methods and systems of the tournament may be applied to video poker tournaments. Thus a video poker player may compete against other video poker players with scores maintained on a computer or network of computers. The system may be configured such that a portion of the return of each participating video poker terminal is used to fund the tournament, as described herein with reference to slot games. Thus, each video poker terminal may yield a lower cash return (80% for example instead of 90%) in order to create a source from which to fund the tournament. The player may monitor tournament results remotely using the Internet or through other means of remote communication.

Each of these embodiments and obvious variations thereof is contemplated as falling within the spirit and scope of the claimed invention, which is set forth in the following claims.

What is claimed is:

1. A gaming system configured to conduct a wagering game tournament including different wagering games conducted on a plurality of gaming machines, the gaming system comprising:

a plurality of gaming machines to conduct the different wagering games, each of the gaming machines including an electronic display device, and one or more electronic input devices, at least one of the one or more electronic input devices configured to detect a physical item that establishes a credit balance, the credit balance changing based on play of the wagering game;

one or more processors; and one or more memory devices; and wherein at least one of the one or more processors cause the gaming system to:

receive, into at least one of the one or more memory devices, a schedule of tournament point awards, wherein each tournament point award corresponds to a probability range of a plurality of probability ranges;

receive, into at least one of the one or more memory devices, a cumulative distribution, by a probability of occurrence, of credit awards in a first wagering game;

receive, into at least one of the one or more memory devices, a cumulative distribution, by a probability of occurrence, of credit awards in a second, different wagering game;

initiate the first or second wagering game on one of the plurality of gaming machines in response to a wager input, the wager input decreasing the credit balance;

determine a randomly selected outcome of the first or second wagering game on one of the plurality of gaming machines;

in response to a first player achieving a first credit award resulting from an outcome of the first wagering game, award a tournament point award of the schedule of tournament point awards to the first player based on the first credit award and the corresponding probability of occurrence of the first credit award; and in response to a second player achieving a second credit award resulting from an outcome of the second wagering game, award a tournament point award to the second player based on the second credit award and the corresponding probability of occurrence of the second credit award.

2. The gaming system of claim 1, wherein the tournament point awards of the schedule of tournament point awards are inversely related to the respective corresponding probability ranges so that higher probabilities correspond with lower tournament point awards and lower probabilities correspond to higher tournament point awards.

3. The gaming system of claim 1, wherein the cumulative distributions of credit awards of the first and second wagering games are divided into separate sections based on the probability of occurrence, and wherein the separate sections correspond to the probability ranges of the plurality of probability ranges.

4. The gaming system of claim 1, wherein the instructions further cause the gaming system to track the tournament point awards awarded to the first and second players, respectively, over multiple plays of the first and second wagering games, and awarding a tournament prize to at least one of the first and second players based on respective accumulated tournament points.

5. The gaming system of claim 4, wherein both the first and second players receive the credit awards achieved in the respective first and second wagering games.

6. The gaming system of claim 4, wherein the multiple plays of the first and second wagering games are a single, designated number of plays.

7. A method of operating a gaming system to conduct a wagering game tournament including different wagering games, the gaming system including one or more processors, one or more memory devices, and a plurality of gaming machines, each gaming machine including an electronic display device, and one or more electronic input devices, the method comprising:

receiving, into at least one of the one or more memory devices, a schedule of tournament point awards, wherein each tournament point award corresponds to a probability range of a plurality of probability ranges;

receiving, into at least one of the one or more memory devices, a cumulative distribution, by a probability of occurrence, of credit awards in a first wagering game;

receiving, into at least one of the one or more memory devices, a cumulative distribution, by a probability of occurrence, of credit awards in a second, different wagering game;

initiating the first or second wagering game on one of the plurality of gaming machines in response to a wager input, the wager input decreasing the credit balance;

determining a randomly selected outcome of the first or second wagering game on one of the plurality of gaming machines;

in response to a first player achieving a first credit award resulting from an outcome of the first wagering game, calculating, via the one or more processors, a first tournament point award of the schedule of tournament point awards for the first player based on the first credit award and the corresponding probability of occurrence of the first credit award, and awarding the first tournament point award to the first player; and in response to a second player achieving a second credit award resulting from an outcome of the second wagering game, calculating, via the one or more processors, a second tournament point award for the second player based on the second credit award and the corresponding probability of occurrence of the second credit award, and awarding the second tournament point award to the second player.

8. The method of claim 7, wherein the tournament point awards of the schedule of tournament point awards are inversely related to the respective corresponding probability ranges so that higher probabilities correspond with lower tournament point awards and lower probabilities correspond to higher tournament point awards.

9. The method of claim 7, wherein the cumulative distributions of credit awards of the first and second wagering games are divided into separate sections based on the probability of occurrence, and wherein the separate sections correspond to the probability ranges of the plurality of probability ranges.

10. The method of claim 7, wherein at least one of the one or more processors cause the gaming system to track the tournament point awards awarded to the first and second players, respectively, over multiple plays of the first and second wagering games, and award a tournament prize to at least one of the first and second players based on respective accumulated tournament points.

11. The method of claim 10, wherein both the first and second players receive the credit awards achieved in the respective first and second wagering games.

12. The method of claim 10, wherein the multiple plays of the first and second wagering games are a single, designated number of plays.

* * * * *